US006709322B2

(12) United States Patent
Saldana et al.

(10) Patent No.: US 6,709,322 B2
(45) Date of Patent: Mar. 23, 2004

(54) APPARATUS FOR ALIGNING A SURFACE OF AN ACTIVE RETAINER RING WITH A WAFER SURFACE FOR CHEMICAL MECHANICAL POLISHING

(75) Inventors: Miguel Angel Saldana, Fremont, CA (US); Damon Vincent Williams, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 62 days.

(21) Appl. No.: 09/823,169

(22) Filed: Mar. 29, 2001

(65) Prior Publication Data

US 2002/0151254 A1 Oct. 17, 2002

(51) Int. Cl.[7] ..... B24B 5/00

(52) U.S. Cl. ..... 451/397; 451/288; 451/285; 451/287

(58) Field of Search ..... 451/5, 6, 11, 26, 451/36, 41, 57, 285, 286, 287, 288, 289, 397

(56) References Cited

U.S. PATENT DOCUMENTS

| | | | | | |
|---|---|---|---|---|---|
| 3,505,766 | A | * | 4/1970 | Boettcher et al. | 451/283 |
| 3,518,798 | A | * | 7/1970 | Boettcher | 451/288 |
| 3,631,634 | A | * | 1/1972 | Weber | 451/24 |
| 3,665,648 | A | * | 5/1972 | Yamanaka | 451/292 |
| 5,205,082 | A | * | 4/1993 | Shendon et al. | 451/41 |
| 5,643,061 | A | * | 7/1997 | Jackson et al. | 451/287 |
| 5,851,136 | A | | 12/1998 | Lee | 451/9 |
| 5,931,725 | A | * | 8/1999 | Inaba et al. | 451/288 |
| 5,951,373 | A | * | 9/1999 | Shendon et al. | 451/41 |
| 6,116,990 | A | | 9/2000 | Sinclair et al. | 451/259 |
| 6,136,715 | A | | 10/2000 | Shendon et al. | 439/692 |
| 6,168,684 | B1 | * | 1/2001 | Mitsuhashi et al. | 156/345.14 |
| 6,354,907 | B1 | * | 3/2002 | Satoh et al. | 451/5 |
| 6,443,815 | B1 | * | 9/2002 | Williams | 451/56 |

FOREIGN PATENT DOCUMENTS

| | | | |
|---|---|---|---|
| EP | 10156712 | 6/1998 | B24B/21/304 |
| EP | 2000334655 | 12/2000 | B24B/37/04 |
| JP | 08320301 | 11/1996 | B24B/37/04 |
| JP | 11145978 | 5/1999 | B24B/37/04 |

* cited by examiner

*Primary Examiner*—Lee D. Wilson
(74) *Attorney, Agent, or Firm*—Martine & Penilla, LLP

(57) ABSTRACT

A CMP system and methods reduce a cause of differences between an edge profile of a chemical mechanical polished edge of a wafer and a center profile of a chemical mechanical polished central portion of the wafer within the edge. The wafer is mounted on a carrier surface of a wafer carrier so that a wafer axis of rotation is gimballed for universal movement relative to a spindle axis of rotation of a wafer spindle. A retainer ring limits wafer movement on the carrier surface perpendicular to the wafer axis. The retainer ring is mounted on and movable relative to the wafer carrier. A linear bearing is configured with a housing and a shaft so that a direction of permitted movement between the wafer carrier and the retainer ring is only movement parallel to the wafer axis, so that a wafer plane and a retainer ing may be co-planar.

17 Claims, 16 Drawing Sheets

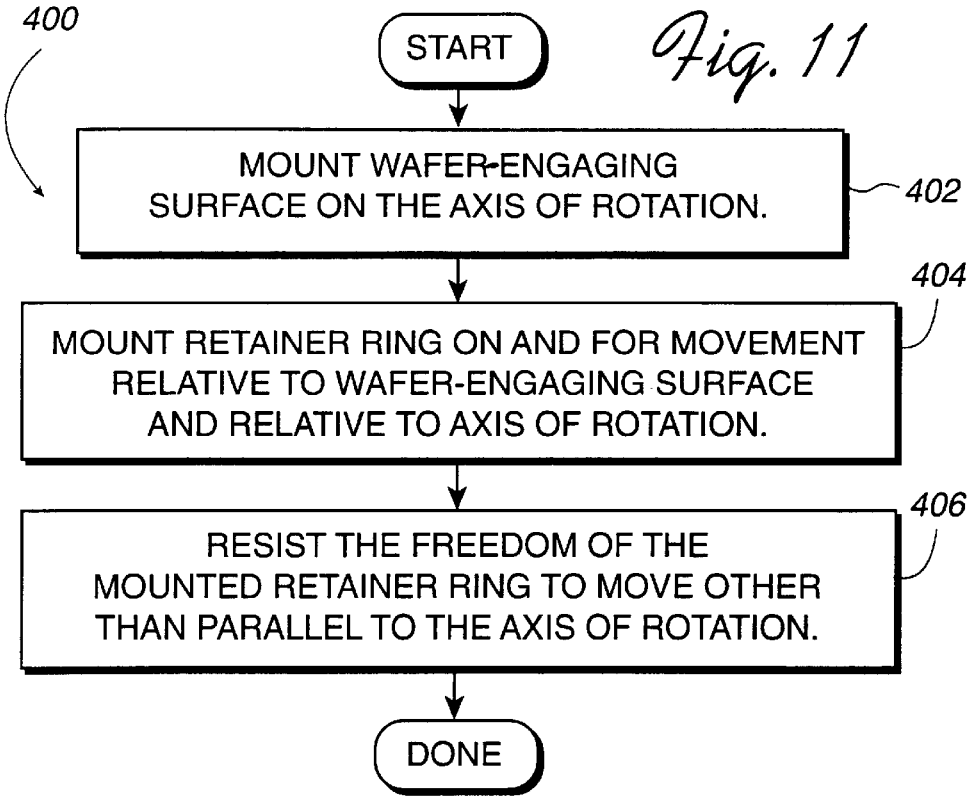
400
START
Fig. 11
MOUNT WAFER-ENGAGING SURFACE ON THE AXIS OF ROTATION.
402
404
MOUNT RETAINER RING ON AND FOR MOVEMENT RELATIVE TO WAFER-ENGAGING SURFACE AND RELATIVE TO AXIS OF ROTATION.
406
RESIST THE FREEDOM OF THE MOUNTED RETAINER RING TO MOVE OTHER THAN PARALLEL TO THE AXIS OF ROTATION.
DONE

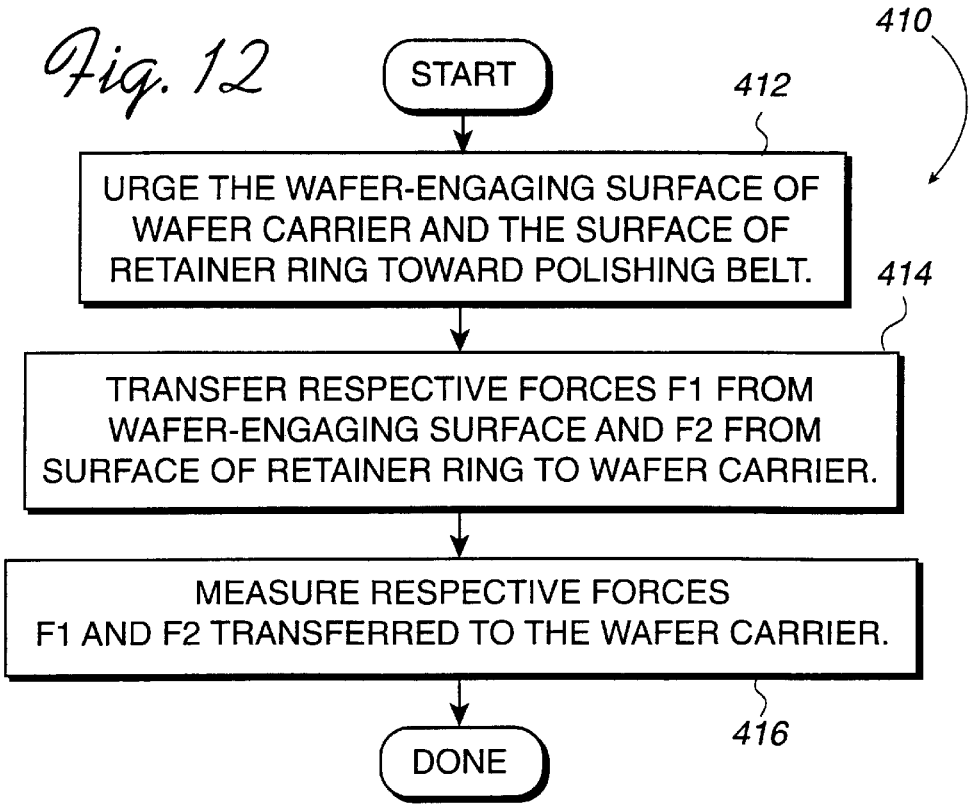
Fig. 12
START
410
412
URGE THE WAFER-ENGAGING SURFACE OF WAFER CARRIER AND THE SURFACE OF RETAINER RING TOWARD POLISHING BELT.
414
TRANSFER RESPECTIVE FORCES F1 FROM WAFER-ENGAGING SURFACE AND F2 FROM SURFACE OF RETAINER RING TO WAFER CARRIER.
MEASURE RESPECTIVE FORCES F1 AND F2 TRANSFERRED TO THE WAFER CARRIER.
416
DONE

APPARATUS FOR ALIGNING A SURFACE OF AN ACTIVE RETAINER RING WITH A WAFER SURFACE FOR CHEMICAL MECHANICAL POLISHING

1. FIELD OF THE INVENTION

The present invention relates generally to chemical mechanical polishing (CMP) systems and techniques for improving the performance and effectiveness of CMP operations. Specifically, the present invention relates to a gimbal-mounted plate for carrying wafers, in which edge effects are reduced by aligning a wafer-engaging surface of the wafer carrying plate with a wafer polisher-engaging surface of an active retainer ring.

2. DESCRIPTION OF THE RELATED ART

In the fabrication of semiconductor devices, there is a need to perform chemical mechanical polishing (CMP) operations on semiconductor wafers, such as those made from silicon and configured as disks of 200 mm or 300 mm in diameter. For ease of description, the term "wafer" is used below to describe and include such semiconductor wafers and other planar structures, or substrates, that are used to support electrical or electronic circuits.

Integrated circuit devices may be in the form of multi-level structures fabricated on such wafers. A transistor device may be formed at one level, and in subsequent levels interconnect metallization lines may be patterned and electrically connected to the transistor device to define the desired functional device. Patterned conductive layers are insulated from other conductive layers by dielectric materials. As more metallization levels and associated dielectric layers are formed, there is an increased need to planarize the dielectric material, such as by performing CMP operations. Without such planarization, fabrication of additional metallization layers becomes substantially more difficult due to variations in the surface topography.

A CMP system typically includes a polishing station, such as a belt polisher, for polishing a selected surface of a wafer. In a typical CMP system, the wafer is mounted on a wafer-engaging surface of a carrier (carrier surface). The mounted wafer has a surface (wafer surface) exposed for contact with a polishing surface, e.g., of a polishing belt. The carrier and the wafer rotate in a direction of rotation. The CMP process may be achieved, for example, when the exposed rotating wafer surface and an exposed moving polishing surface are urged toward each other by a force, and when the exposed wafer surface and the exposed polishing surface move relative to each other. The carrier surface is said to define a carrier plane, the exposed wafer surface is said to define a wafer plane, and the exposed polishing surface in contact with the wafer plane is said to define a polishing plane.

In the past, the wafer carrier has been mounted on a spindle that provides rotation and polishing force for the carrier. To enable the wafer carrier to properly position the exposed wafer surface for desired contact with the exposed polishing surface, for example, a gimbal has been provided between the spindle and the wafer carrier. The gimbal allows the carrier plane to tilt relative to a spindle axis around which the wafer carrier rotation occurs. Such tilting allows the carrier plane to be parallel to the polishing plane of the belt. Generally, however, provision of the gimbal results in more mechanical structures between the carrier surface and a force sensor mounted on the spindle. As a result, there is more of an opportunity for friction in the mechanical structures to reduce the force sensed by the sensor.

Others have provided so-called active retainer rings that support the wafer against horizontal forces to retain the wafer on the carrier plate. However, the design of such active retainer rings has not appreciated an adverse feature of such active retainer rings. Thus, such design did not take into account a gimbal-like action of such active retainer rings. Such action of such retainer ring mounted on the carrier may be appreciated in terms of a retainer ring plane defined by an exposed surface of the retainer ring (the ring surface). Such design did not appreciate that a lack of guidance of such active retainer ring allows such retainer ring plane to be positioned axially offset from the wafer plane in response to forces, such as a horizontal force of the belt acting on the ring surface. The amount of the offset may be referred to as a reveal, and if the reveal is positive, the wafer plane is closer than the ring plane to the polishing plane of the belt. In general, a negative reveal is used to properly seat, or position, the wafer on the carrier surface prior to polishing.

As an example of the lack of guidance of such prior active retainer rings, the motor, such as a bladder, that drives such an active retainer ring relative to the wafer has been flexible and allowed the retainer ring plane to move in an uncontrolled manner relative to the carrier plane and relative to the wafer plane. This uncontrolled relative retainer ring-wafer carrier movement has allowed the retainer ring plane to tilt and become out-of-parallel with respect to both the carrier plane and the wafer plane. Unfortunately, in the tilted orientation, the retainer ring is not co-planar with the wafer plane. As a result, such tilting results in the value of the reveal being different at different angles along the circumference of the wafer and of the retainer ring, i.e., around the carrier axis of rotation. Such differences in the values of the reveal are undesirable because, for example, they are uncontrolled and have caused problems in CMP operations. The problems may be understood in terms of the edge of the wafer, which generally includes an annular portion of the wafer surface extending from the outer periphery of the wafer inwardly about 5 to 8 mm, for example. The problems in CMP polishing arise because the variation in the value of the reveal results in the vertical profile of the edge of the polished wafer having a different value for each different value of the reveal.

What is needed then, is a way of allowing the retainer ring to move relative to the wafer plane while limiting the movement of the retainer ring so as to avoid such tilting. What is also needed is a way to prevent the retainer ring plane from becoming out-of-parallel with respect to both the carrier plane and the wafer plane so that the retainer ring plane and the wafer plane may be aligned, i.e., co-planar. What is also needed are structure and methods of allowing the retainer ring to move relative to the wafer plane while avoiding relative movement that results in the value of the reveal being different at different angles of rotation of the wafer and the retainer ring on the carrier axis of rotation. In particular, currently there is an unmet need for structure and methods of providing a uniform profile of the edge of a wafer in CMP operations while retaining the advantages of retainer rings that are actively moved relative to the wafer plane.

SUMMARY OF THE INVENTION

Broadly speaking, the present invention fills these needs by providing CMP systems and methods which implement solutions to the above-described problems, wherein structure and methods are provided for allowing a retainer ring to move relative to a wafer plane while limiting the movement of the retainer ring so as to avoid such tilting that causes the retainer ring plane to become misaligned (i.e., out-of-parallel with respect to both the carrier plane and the wafer plane, or not co-planar with the wafer plane). In such systems and methods, the retainer ring may move relative to the wafer plane, but the relative movement is limited so that for polishing the wafer the retainer ring plane and the wafer plane may be co-planar. In particular, the direction of the relative movement is limited to a direction perpendicular to the wafer plane and the carrier plane, whereby the value of any desired reveal remains the same at different angles around the periphery of the wafer and of the retainer ring, i.e., around the carrier axis of rotation. Thus, the advantages of retainer rings that are actively moved relative to the wafer plane are retained without having the non-uniform reveal problem.

In one embodiment of the systems and methods of the present invention, a carrier plate is provided with a carrier surface to support a wafer. A retainer ring is mounted on and for movement relative to the carrier plate. A linear bearing arrangement is mounted between the carrier plate and the retainer ring. The arrangement is configured to limit the movement of the retainer ring relative to the carrier, wherein permitted movement keeps the retainer ring plane parallel to the wafer plane, or for polishing, co-planar with the wafer plane.

In another embodiment of the systems and methods of the present invention, an assembly including the carrier plate is provided with a gimbal to movably mount the carrier plate relative to a spindle housing. The spindle housing is mounted on a drive spindle. The gimbal allows the carrier plate to move so that the wafer plane may move and become co-planar with the polishing plane during the CMP operations. The retainer ring is mounted on and for movement relative to the carrier plate, and thus may also move relative to the wafer. However, the linear bearing arrangement constrains both such relative movements by permitting only movement of the retainer ring relative to the carrier plate along a path parallel to a central axis of the carrier plate.

In yet another embodiment of the systems and methods of the present invention, the linear bearing arrangement is provided as an array of separate linear bearing assemblies spaced around the wafer carrier.

In still another embodiment of the systems and methods of the present invention, the linear bearing arrangement is provided as an array of separate linear bearing assemblies in conjunction with the retainer ring, wherein a force applied to the retainer ring by the polishing belt is transferred to the carrier plate parallel to an axis of the carrier plate to facilitate calibration of the retainer ring.

In a related embodiment of the systems and methods of the present invention, the linear bearing arrangement is assembled with the retainer ring in conjunction with a motor for moving the retainer ring relative to the wafer mounted on the carrier so that an exposed surface of the wafer and a surface of the retainer ring to be engaged by the polishing pad are co-planar during the polishing operation.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements.

FIG. 11 depicts a flow chart illustrating operations of a method of the present invention for aligning an exposed surface of the retainer ring with a wafer;

FIG. 12 depicts a flow chart illustrating operations of a method of the present invention for transferring respective forces from the wafer-engaging surface and from the retainer ring surface to the wafer carrier;

DETAILED DESCRIPTION OF THE PREFERRED EMBODIMENTS

An invention is described for a CMP system, and methods, which enable precision controlled polishing of an exposed surface of a wafer. The present invention fills the above-described needs by providing CMP systems and methods which implement solutions to the above-described problems, wherein structure and methods are provided for allowing a retainer ring to move relative to a wafer plane while limiting the movement of the retainer ring so as to avoid tilting that causes the retainer ring plane to become out-of-parallel with respect to both the carrier plane and the wafer plane. In such systems and methods, the retainer ring plane may move relative to the wafer plane, but the relative movement is limited. The direction of the relative movement is limited to a direction perpendicular to the wafer plane and to the carrier plane. As a result, for polishing the wafer, the wafer plane and the retainer ring plane may be co-planar. Also, the value of a desired reveal remains the same at different angles around the periphery of the wafer and of the retainer ring, i.e., around the carrier axis of rotation. Thus, the advantages of retainer rings that are actively moved relative to the wafer plane are retained without having the problem resulting from a non-uniform reveal or lack of such co-planarity.

In the following description, numerous specific details are set forth in order to provide a thorough understanding of the present invention. It will be understood, however, to one skilled in the art, that the present invention may be practiced without some or all of these details. In other instances, well known process operations have not been described in detail in order not to obscure the present invention.

Figure 1:
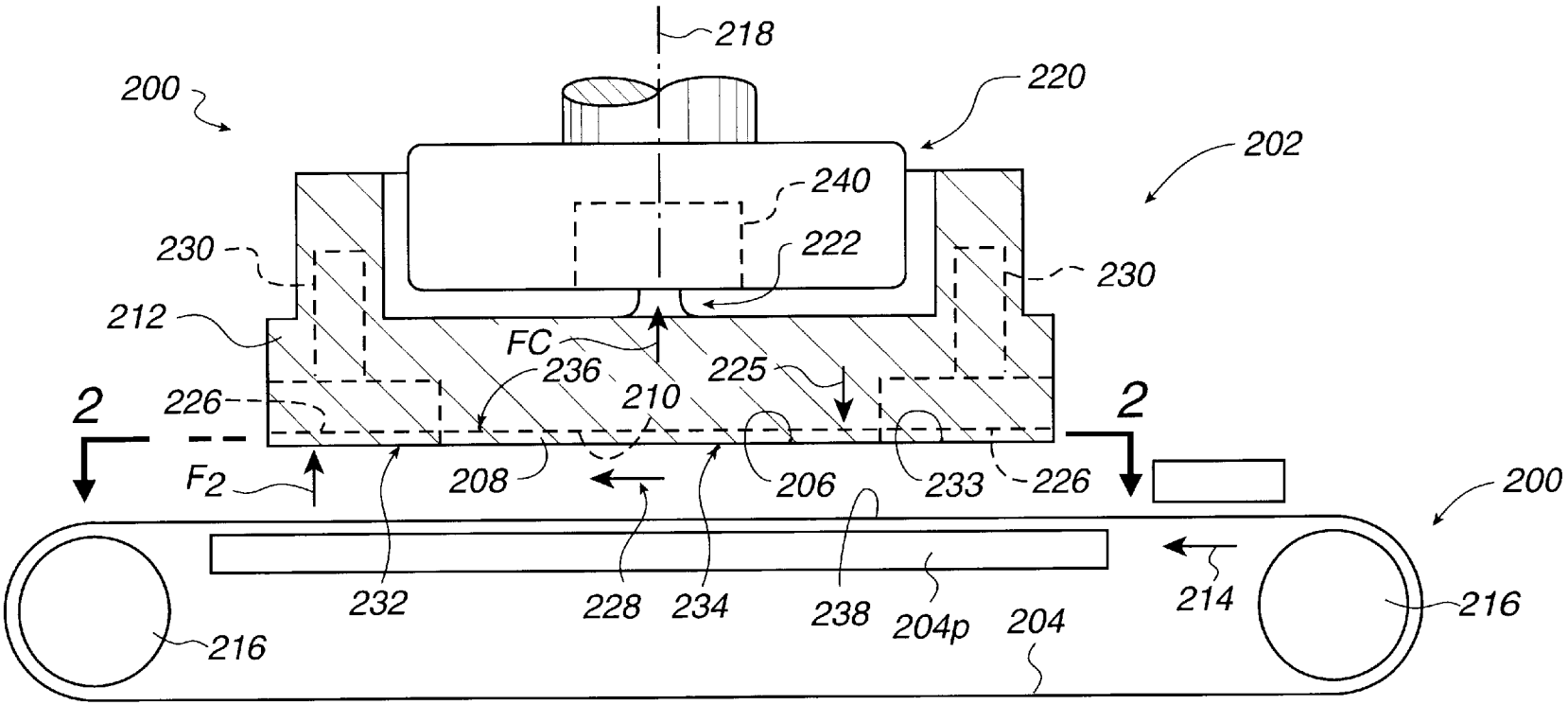
FIG. 1 is a schematic elevational view showing an embodiment of the present invention in which a wafer carrier plate supports a wafer and a retainer ring for contact with a chemical mechanical polishing surface.
Figure 2:
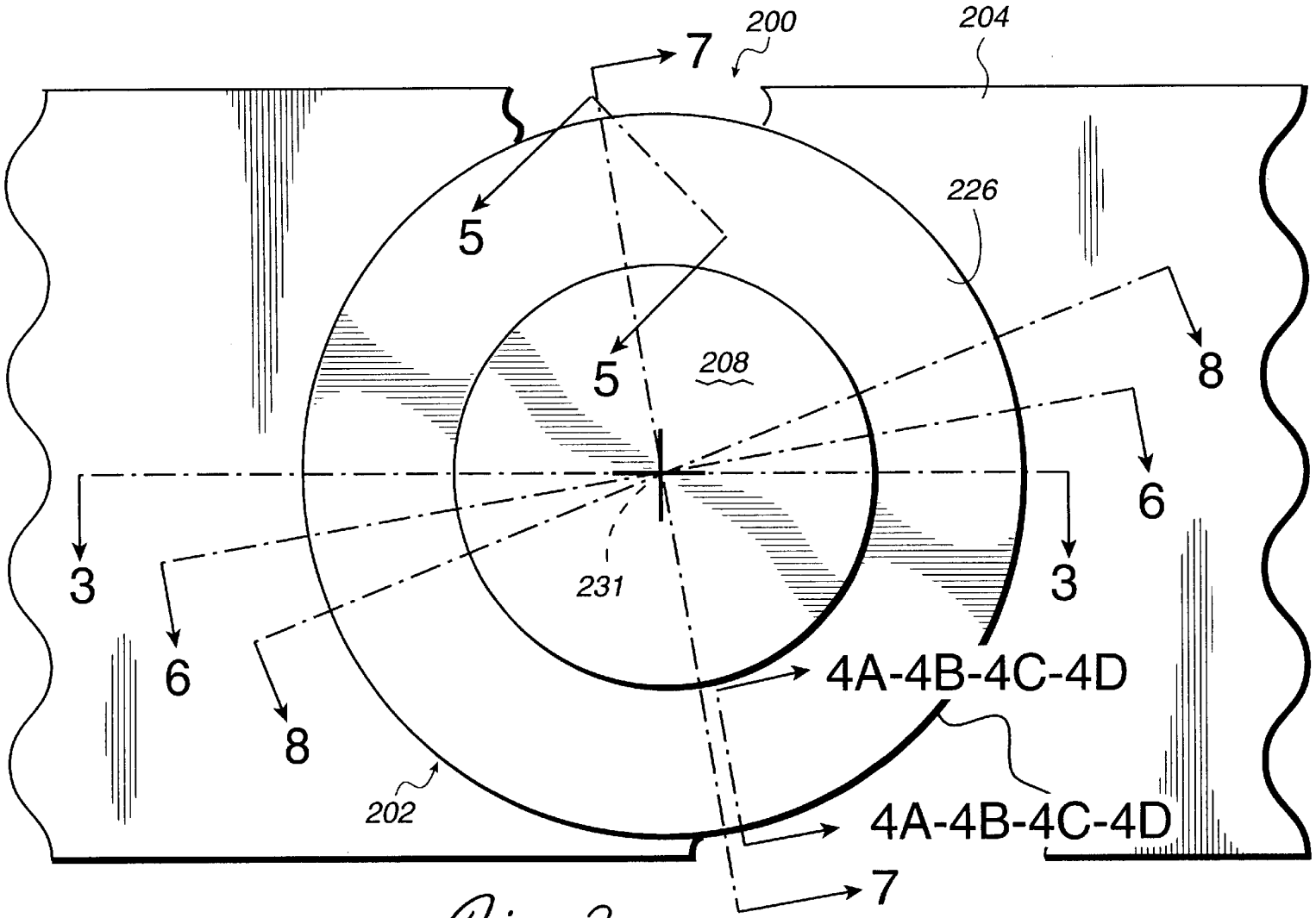
FIG. 2 is a plan view taken along line 2—2 in FIG. 1, schematically showing the polishing surface, depicted as a belt, for contact with both the wafer carried by the wafer carrier plate and the retainer ring that surrounds the wafer.

Referring to FIGS. 1 and 2, there is schematically shown an embodiment of the present invention, including a CMP system 200. The embodiment of FIGS. 1 and 2 includes a polishing head 202 configured with an endless belt 204 to polish an exposed surface 206 of a wafer 208 mounted on a wafer carrier surface 210 of a wafer carrier 212. The wafer 208 may be any of the wafers described above, for example. The polishing head 202 is designed to polish the surface 206 of the wafer 208 utilizing the belt 204. The belt 204 may be made from CMP materials, fixed abrasive pad materials, etc. In general, any pad material that enables the desired polishing levels and precision can be used for the belt 204. In a preferred embodiment, the belt 204 may have a stainless steel core with an IC 1000 polishing pad, for example.

Figure 3:
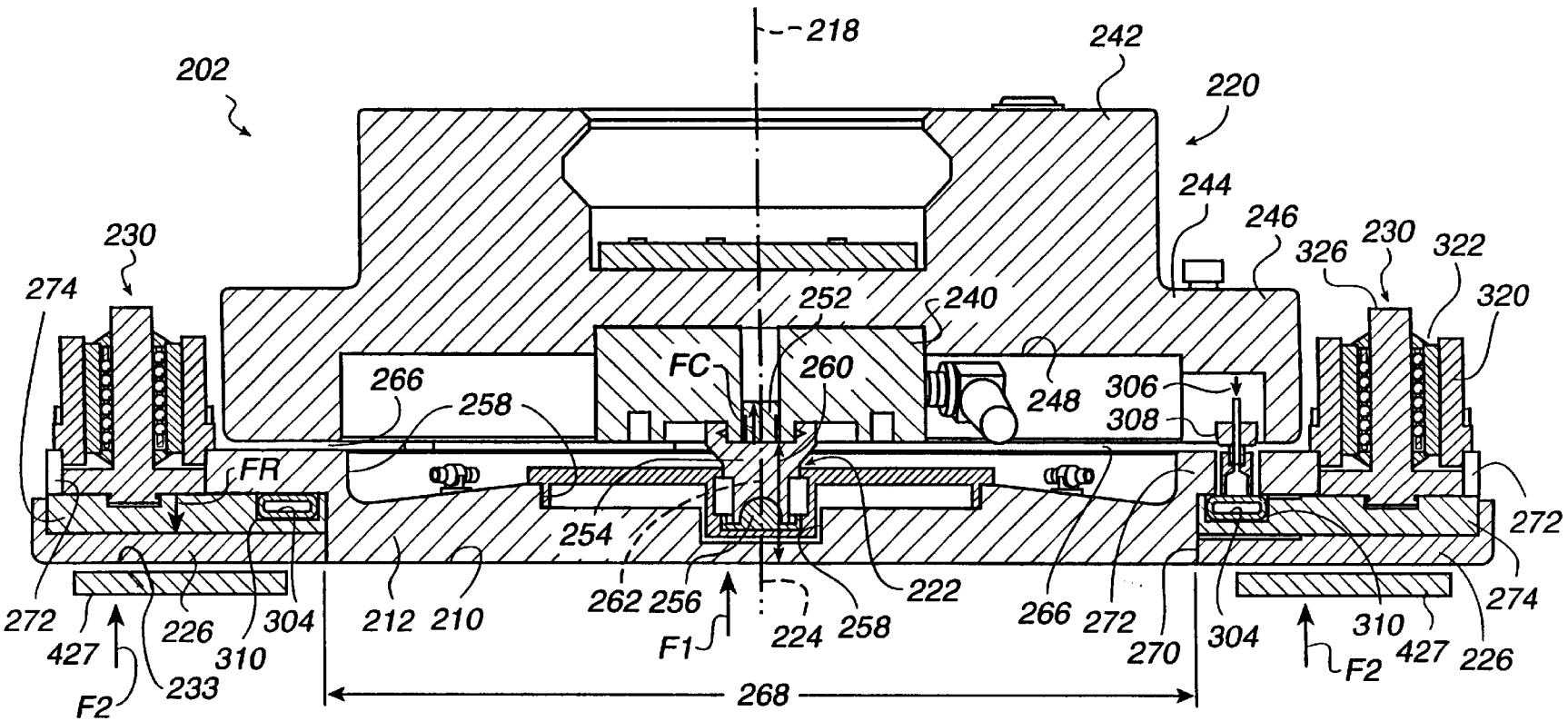
FIG. 3 is a cross sectional view taken along line 3—3 in FIG. 2 schematically showing a gimbal assemblage that allows an axis of rotation of the wafer carrier plate to move relative to an axis of rotation of a spindle, illustrating linear bearing assemblies between the wafer carrier plate and the retainer ring.
Figure 4A:
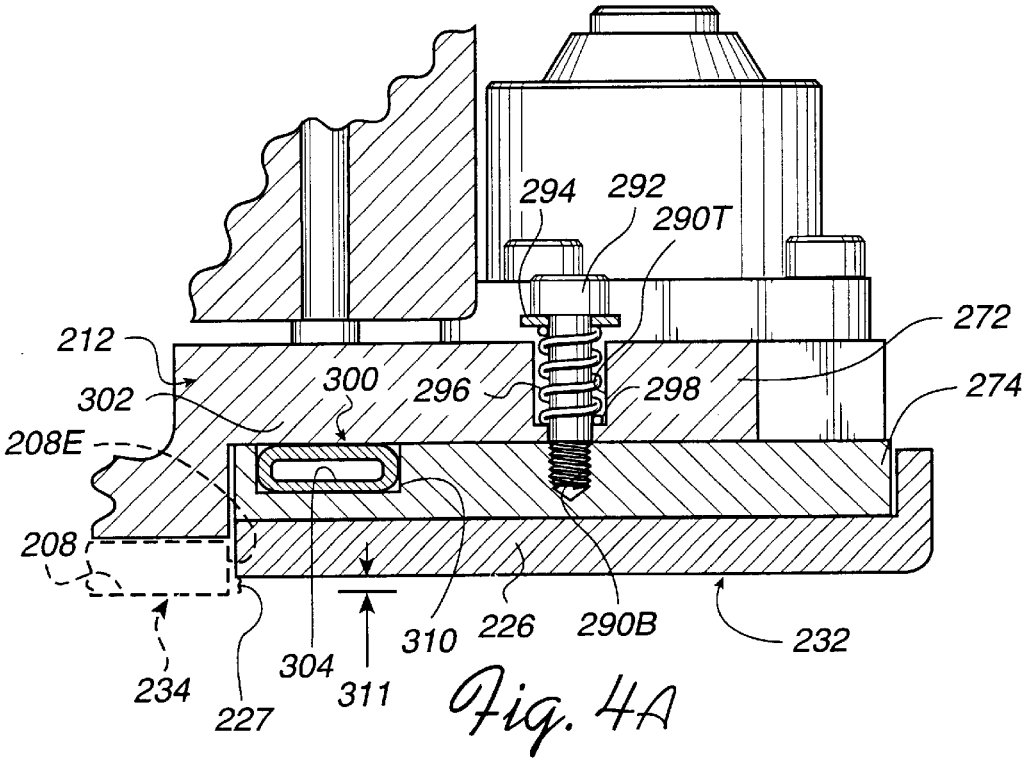
FIG. 4A is a cross sectional view taken along line 4A—4A in FIG. 2 showing a connector shaft maintaining the retainer ring assembled to the carrier plate and a spring biasing the retainer ring into a position in which a retainer ring reveal has a maximum value for positioning the wafer on the carrier plate.
Figure 4B:
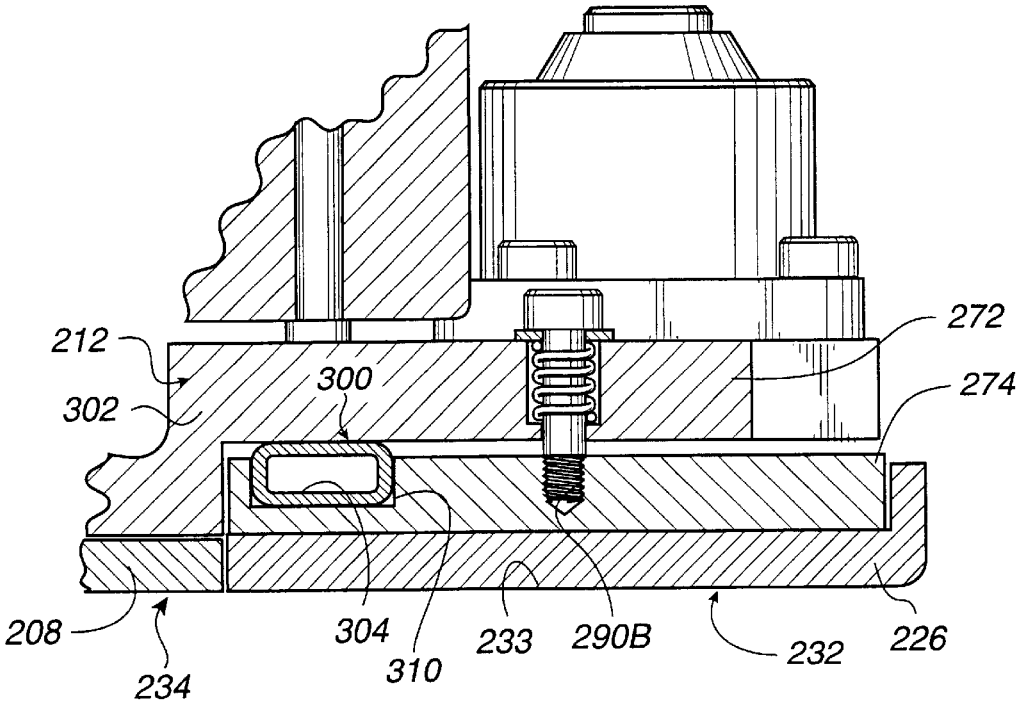
FIG. 4B is a cross sectional view similar to FIG. 4A, showing a linear motor for moving the retainer ring in opposition to the force of the spring, wherein the retainer ring is shown in a position in which the retainer ring reveal has a zero value for polishing the wafer.
Figure 4C:
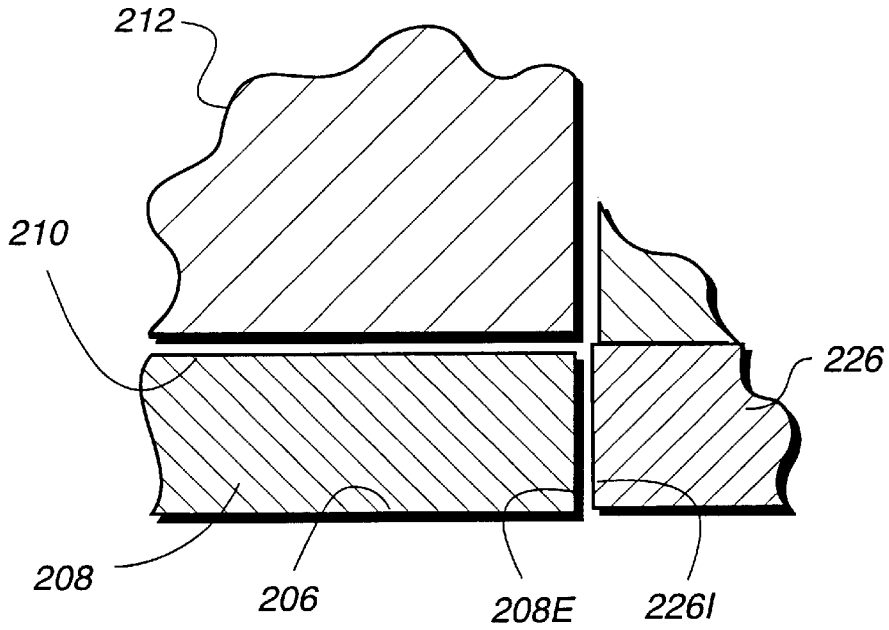
FIG. 4C is an enlarged view of a portion of FIG. 4B, illustrating the zero value of the reveal and co-planarity of the retainer ring plane and the wafer plane.
Figure 4D:
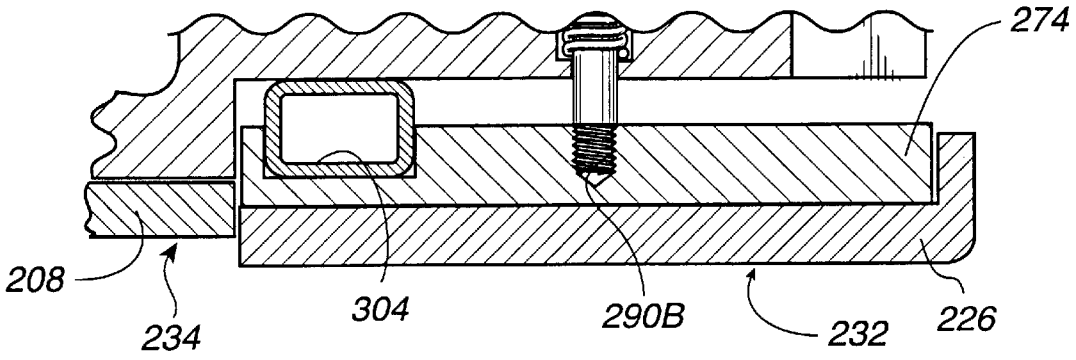
FIG. 4D is a cross sectional view similar to FIGS. 4A and 4B, illustrating the linear motor having moved the retainer ring to a position a maximum distance away from the wafer carrier to facilitate positioning the wafer on the carrier plate.

The polishing belt 204 performs CMP of the wafer 208, and for this purpose is linearly moved (see arrow 214) by spaced capstans 216. The capstans 216 move the belt 204 relative to an axis of rotation 218 of a spindle 220. The spindle 220 is both rotated around the axis 218 and urged toward the belt 204 parallel to the axis 218. Referring also to FIG. 3, the spindle 220 is mounted to the wafer carrier 212 by a gimbal assembly 222 that allows the wafer carrier 212 to move and position a carrier axis of rotation 224 (FIG. 3) at an angle, or tilted, relative to the spindle axis 218. The wafer carrier 212 is urged by the spindle 220 toward the belt 204. In turn, the exposed surface 206 of the wafer 208 mounted on the wafer carrier surface 210 is urged by a polishing force (see arrow 225 in FIG. 1) against the belt 204 for performing CMP operations. The belt 204 is backed by a belt plate 204*p* to resist the polishing force 225. A retainer ring 226 is movably mounted on the wafer carrier 212. The retainer ring 226 may be moved to expose a portion of a peripheral edge 208E (FIG. 4A) of the wafer 208. The exposed portion of the edge 208E is referred to as a reveal 227, and FIG. 4A shows a maximum value of the reveal 227. The retainer ring 226 may be moved away from the carrier 212 to a zero reveal polishing position (FIGS. 4B and 4C). In the zero reveal position, there is no exposed portion of the edge 208E of the wafer 208, (i.e., no reveal 227). In FIGS. 4B and 4C, an inner peripheral edge 226I surrounds the edge 208E of the wafer 208 to hold the wafer 208 centered on the axis 224 against frictional polishing forces (see arrow 228 in FIG. 1) exerted by the belt 204 on the surface 206 of the wafer 208. The retainer ring 226 may be moved further away from the carrier 212 as shown in FIG. 4D so that a plane 232 defined by a surface 233 of the ring 226 is positioned beyond a plane 234 defined by the exposed surface 206 of the wafer 208 to facilitate easy mounting of the wafer 208 on the carrier 212. This is referred to as a wafer mounting position of the retainer ring 226.

Linear bearing assemblies 230 (shown in dashed lines in FIG. 1) are provided between the retainer ring 226 and the wafer carrier 212 to limit the movement of the retainer ring 226 relative to the carrier 212 to movement parallel to the carrier axis 224 and parallel to an axis 231 of symmetry (or rotation) of the wafer 208. Such limiting assures parallelism among the plane 232 defined by the surface 233 of the retainer ring 226, and the plane 234 defined by the exposed wafer surface 206 of the wafer 208 mounted on the wafer carrier surface 210, and a plane 236 defined by the surface 210 on which the wafer 208 is mounted. During polishing, such limiting assures co-planarity of the planes 232 and 234. Since the gimbal assembly 222 allows the wafer carrier 212 to move and position the carrier axis of rotation 224 (FIG. 3) tilted relative to the spindle axis 218, the retainer ring plane 232 and the wafer plane 234 and the wafer carrier surface plane 236 may move parallel not only to each other but parallel to a plane 238 defined by the portion of the belt 204 engaged by the wafer surface 206 and the ring surface 233. The limitation of movement imposed by the linear bearing assemblies 230 thus restricts the movement allowed by the gimbal assembly 222.

As described, the spindle 220 is urged toward the belt 204 parallel to the axis 218. With the support of the back plate 204*p*, the belt 204 resists such urging and applies a force F1 (FIG. 3) on the exposed wafer surface 206 and a force F2 on the exposed ring surface 233. With the retainer ring 226 mounted on the wafer carrier 212, and the linear bearing assemblies 230 limiting the movement of the retainer ring 226 to movement parallel to the axis of rotation 224 of the carrier 212, the forces F1 and F2 are parallel, and parallel to the axis 224. These forces F1 and F2 combine and a component FC of these forces F1 and F2 that is parallel to the spindle axis 218 is sensed by a load cell 240 (shown in dashed lines in FIG. 1). Signals (not shown) from the load cell 240 in response to the sensed component FC may be used to control the force by which the spindle 220 is urged toward the carrier 212.

Figure 6:
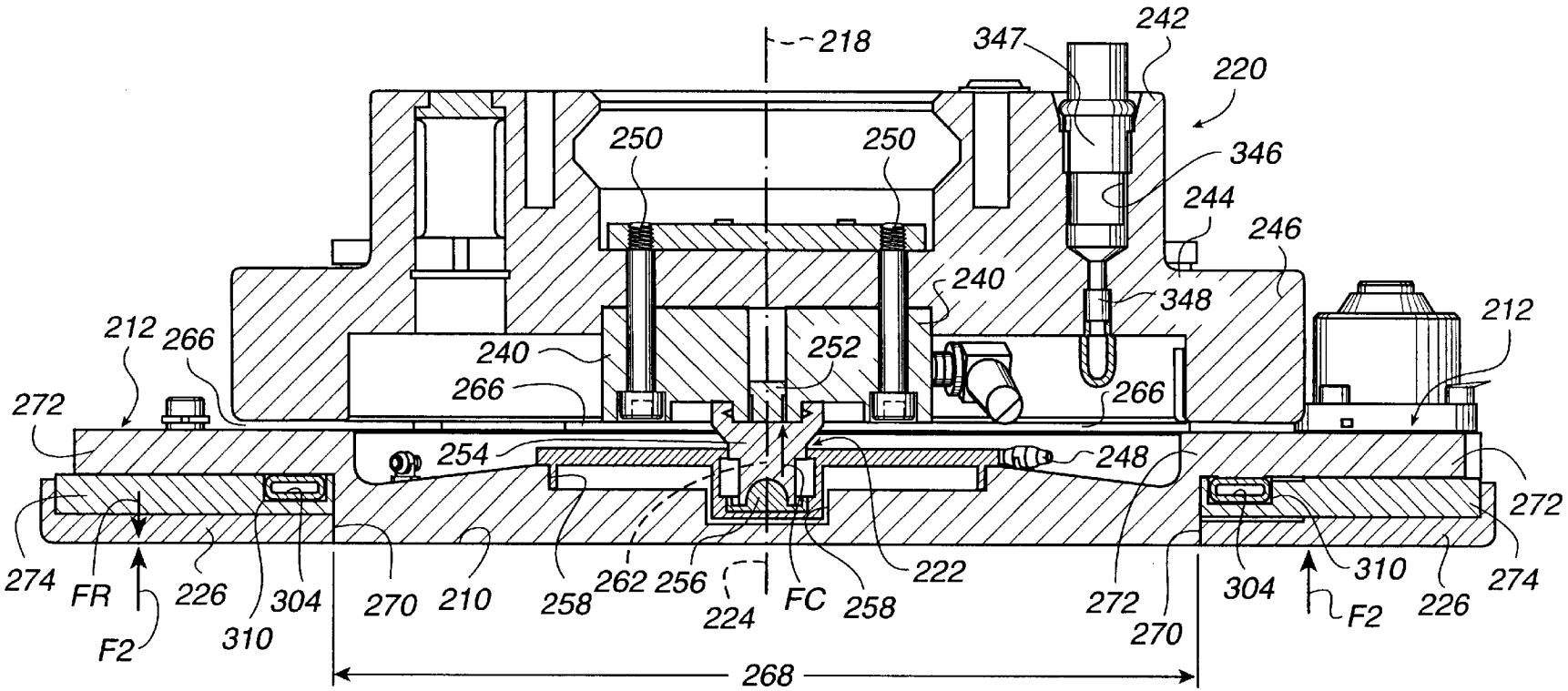
FIG. 6 is a cross sectional view taken along line 6—6 in FIG. 2 showing a vacuum and gas supply line provided in the spindle and connected to the wafer carrier plate.

Referring to FIGS. 3 and 6, the axis 218 of the spindle 220 is shown. The spindle 220 may include a conventional cam operated connector, or base, 242. The base 242 is secured in a well-known manner to another connector (not shown) of the spindle 220 so that the base 242 receives the rotation and urging for the CMP operations. The base 242 is provided with a shoulder 244 and a flange 246. The flange 246 is cut away to define a stepped cavity 248 that receives the load cell 240. The load cell 240 may be a standard strain gauge such as Model Number LPU-500-LRC sold by Transducer Techniques, of Temecula, Calif. The load cell 240 may have a load sensing range of from about zero pounds of force to 500 pounds of force. More preferably, a more accurate load sensing range may be used, e.g., from about zero to about 400 pounds of force. The load cell 240 is secured to the base 242 by bolts 250 (FIG. 6). The load cell 240 has an input, or sensor tip, 252 configured for attachment to a first gimbal member, or spherical gimbal socket, 254 of the gimbal assembly 222. The socket 254 receives a second gimbal member, or gimbal ball, 256. The ball 256 is mounted to the wafer carrier 212 in a cavity 258. The cavities 248 and 258 are opposed and are configured to enable the wafer carrier surface 210 to be very close to the input 252 (see dimension 260, FIG. 3). Further, as described below, the gimbal assembly 222 provides a minimum of mechanical assemblies between the cavity 248 and the cavity 258. In this manner, friction losses between the wafer carrier 212 and the load cell 240 are reduced, fostering more accurate measuring of the force FC. In this manner, the force sensed by the load cell 240 is a more accurate representation of the force FC. As described below, calibration operations determine the value of a force FR (FIGS. 3 and 14) of the retainer ring 226 corresponding to various actuating pressures PB (FIG. 14) applied to a linear motor 300.

The spindle axis 218 is aligned with a central axis 262 (FIG. 6) of the socket 254. Permitted movement (referred to as gimballing movement) of the ball 256 relative to the socket 254 allows the central axis 224 of the wafer carrier, and the axis of the ball 256 (that is co-axial with the carrier axis 224), to move relative to the socket axis 262 and to the spindle axis 218. Space 266 (e.g., an air gap) is provided between the base 242 and the wafer carrier 212 to allow the gimballing movement. The space 266 may be from about 0.100 inches to about 0.050 inches. The component FC of force from the forces F1 and F2 is transferred from the wafer carrier 212 to the ball 256 and to the socket 254 to the input 252 to actuate the load cell 240.

Figure 7:
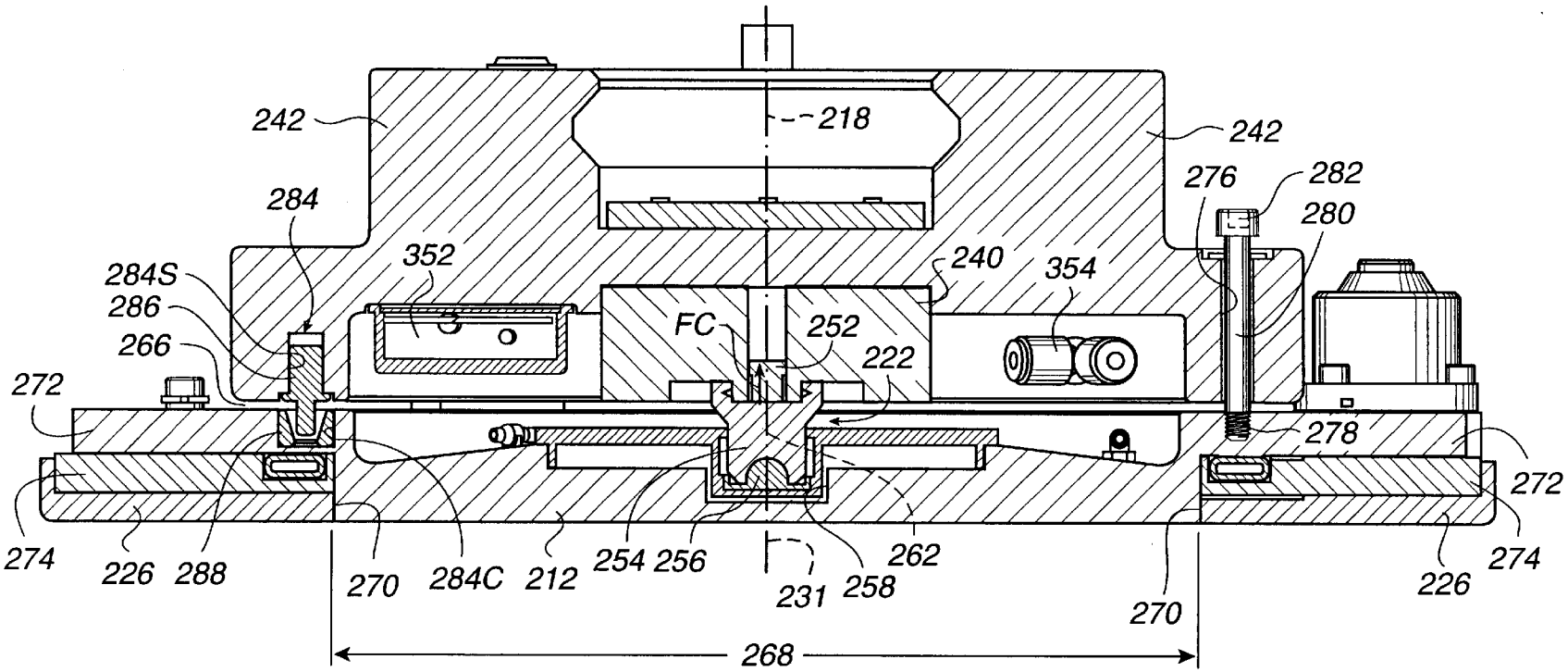
FIG. 7 is a cross sectional view taken along line 7—7 in FIG. 2 showing the gimbal assemblage connected to a load cell and the gimbal assemblage including a drive pin received in a tapered cavity of the wafer carrier plate.

Referring to FIGS. 3, 6 and 7, the wafer carrier 212 is shown having the wafer carrier surface 210 provided with a diameter 268 about equal to the diameter of the wafer (e.g., about 200 or 300 mm.). Such surface 210 is opposite to the cavity 258. Adjacent to an outer edge 270 of the carrier 212 and at locations spaced from each other by about 90 degrees, tabs, or mounting sections, 272 extend outwardly from the carrier 212, and upwardly in the FIGs. The tabs 272 extend over a retainer ring base 274 and over the retainer ring 226.

FIG. 7 shows one of three bores 276 provided in the spindle base 242 aligned with respective threaded bores 278 provided in the respective tabs 272. Each of the bores 276 is configured with a diameter larger than that of respective screws 280 threaded into the respective threaded bores 278. The larger diameters provide room to permit the gimballing movement, while respective screw heads 282 keep the wafer carrier 212 attached to the spindle base 242. Additionally, FIG. 7 shows one of three sets of opposed bores 284. Each bore 284S of the base 242 receives a respective drive pin 286 that extends across the space 266 and into a respective tapered bearing 288 received in one of the bores 284C. As the carrier 212 may move in the gimballing movement, the shapes of the bearing 288 and the pin 286 avoid interference with the gimballing movement.

Figure 8:
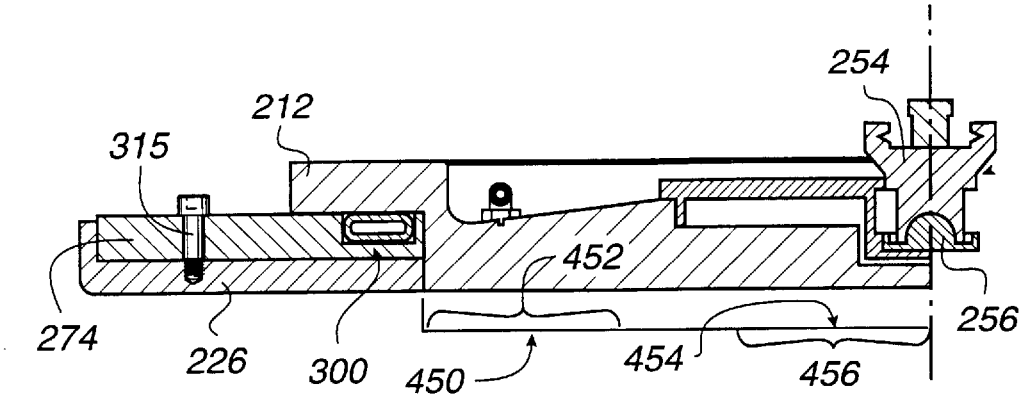
FIG. 8 is a cross sectional view taken along line 8—8 in FIG. 2 showing the retainer ring secured to a retainer ring base.

FIG. 4A shows one of four sets of opposed, aligned bores 290 in the tab 272 (see 290T) and in the retainer ring base 274 (see 290B). Each bore 290T of the tab 272 is configured to receive a bolt 292 (having a washer 294) and a spring 296. Each bore 290B of the retainer ring base 274 is configured to receive a threaded end of the bolt 292. A shoulder 298 is provided in the bore 290T so that the spring 296 is compressed between the shoulder 298 and the washer 294. With the bolt 292 threaded into the threaded bore 290B of the retainer ring base 274, the compressed spring 296 urges the bolt 292 upwardly in FIG. 4A to pull the base 274 and the retainer ring 226 upwardly so that the base 274 normally contacts the tabs 272. Referring to FIG. 8, which shows a portion of the base 274 and the retainer ring 226, the base 274 and the retainer ring 226 are bolted together by bolts 315 and move together as a unit.

FIG. 4A shows that with the base 274 in contact with the tabs 272, the plane 232 of the retainer ring 226 is closer to the tabs 272 than the wafer plane 234 (shown in dashed lines). In this position, it may be said that the value of the reveal 227 is a maximum, or full, indicated by the dimension 331 having a maximum positive value. This maximum value of the dimension 311 may be about one-half of the thickness of the wafer 208, for example. In contrast, FIGS. 4B and 4C show the reveal 227 having a minimum, or zero, value, with the wafer plane 234 co-planar with the retainer ring plane 232.

To provide movement of the retainer ring 226 (e.g., to change the value of the reveal 227), the linear motor 300 is mounted between an annular portion 302 of the tabs 272 and the retainer ring base 274. The linear motor 300 may preferrably be provided in the form of a sealed cavity, or more preferably in the form of a pneumatic motor or an electro-mechanical unit. A most preferred linear motor 300 is shown including a pneumatic bladder 304 supplied with pneumatic fluid (see arrow 306, FIG. 3) through an inlet 308. As shown in FIGS. 3, 4A and 4B, the retainer ring base 274 is provided with an annular groove 310 for receiving the bladder 304. The linear motor 300 is selectively actuated by supplying the fluid 306 to the bladder 300 at the different amounts of pressure PB (FIG. 14) according to the amount of a desired stroke of the bladder 304. Such stroke may in turn provide a particular amount, or value, of the reveal 227 (FIG. 4A), if any. FIG. 4D shows a maximum stroke of the bladder 304, which for example may be 0.050 inches measured parallel to the axis 224. Such maximum stroke is from the position shown in FIG. 4A (with the maximum reveal 227), and compares to a vertical dimension (or thickness) of the wafer 208, which may be 0.030 inches.

For purposes of description, the carrier 212 may be said to be fixed in the vertical direction, such that when the fluid 306 is admitted into the bladder 304 the bladder 304 will urge the retainer ring base 274 downwardly from the full reveal position shown in FIG. 4A. The amount of the downward movement corresponds to the value of the pressure PB of the fluid 306 (FIG. 14) introduced into the bladder 304. The bladder 304 will thus move the retainer ring base 274, and thus the retainer ring 226, down (in this example) relative to the wafer 208 positioned on the wafer carrier surface 210. The pressure PB of the fluid 306 introduced to the bladder 304 may be one of many pressures, for example. In a general, preliminary, sense, the pressure PB may be selected to move the retainer ring 226 from the full reveal position (FIG. 4A) through one of many reveal positions in which the reveal 227 has a positive value, to the zero reveal position shown in FIGS. 4B and 4C. Higher values of the pressure PB may be selected to move the retainer ring 226 further downward into the wafer mounting position shown in FIG. 4D. The pressure PB may be in a range of from zero (in the maximum reveal position shown in FIG. 4A) to about fifteen psi. to about seven to ten psi, for example, in the wafer mounting position shown in FIG. 4D.

The polishing (zero reveal) position is the desired position of the retainer ring 226 during polishing of the wafer 208. Moreover, in the polishing position shown in FIGS. 4B and 4C, because of the operation of the linear bearing assemblies230, the wafer plane 234 and the ring plane 232 are co-planar and the reveal 227 has a zero value all around the perimeter of the wafer 208. As a result, as the belt 204 moves in the direction of the arrow 214 (FIG. 1) the ring plane 232 will not be free to tilt relative to the axis 224. Thus, the ring 226 will not dig into the belt 204. Further, a portion of the belt 204 will first contact and traverse over the retainer ring 226. This contact and traverse will cause a dynamic condition of the portion of the belt 204, e.g., the belt 204 will assume a wave-like shape. However, the continued traverse of the portion of the belt 204 over the retainer ring 226 will tend to allow this wave-like shape to decrease. Therefore, by the time the portion of the belt 204 reaches the outer edge of the wafer 208 the belt 204 will have a relatively flat, non-wave-like shape. Further, with the plane of the ring 226 co-planar with the wafer plane 234 (due to the operation of the linear bearing assemblies 230), as the portion of the belt 204 crosses from the ring 226 onto the edge of the wafer 208, there will be a minimum disturbance of the portion of the belt 204. Such disturbance is significantly less than the disturbance that results from the above-described non-co-planar relationship of the ring plane 232 and the wafer plane 234. Thus, the relatively flat or planar portion of the belt 204 will more readily start to polish the wafer surface in a desired relatively flat (or planar) profile.

Figure 5:
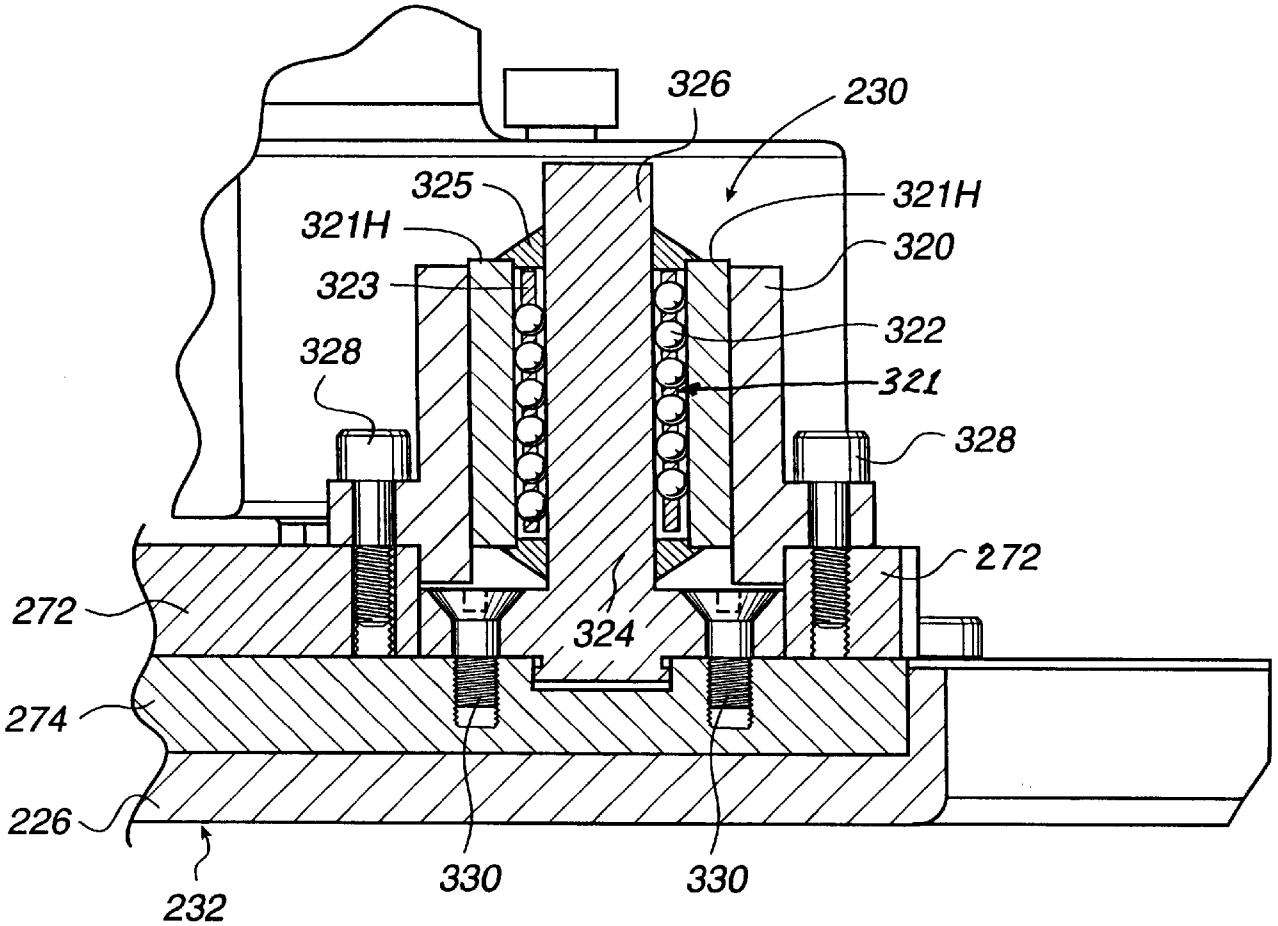
FIG. 5 is a cross sectional view taken along line 5—5 in FIG. 2 showing various fasteners for mounting a linear bearing assembly between the carrier plate and the retainer ring so that relative movement between the carrier plate and the retainer ring is limited to a direction perpendicular to the wafer plane and the carrier plane.

As described above, the four linear bearing assemblies 230 limit the movement of the retainer ring 226 so that the plane 232 of the ring 226 remains parallel to the plane 234 of the wafer 208 and to the plane 236 of the carrier surface 210. FIGS. 3 and 5 depict one of the linear bearing assemblies 230. Each linear bearing assembly 230 includes a main bearing housing 320 provided with a linear ball bearing assembly 321. The linear ball bearing assembly 321 includes an internal bearing housing 321H that receives a set of bearing balls 322 held in a cage 323. The bearing balls 322 receive a bearing shaft 326 that is dimensioned to provide an interference fit with the bearing balls 322 to preload the bearing balls 322. The linear bearing assemblies 321 may be linear bearing Model Number ML 500-875 sold under the trademark ROTOLIN by RBM of Ringwood, N.J., for example.

The shaft 326 is hardened, such as to at least Rc 60 and is ground to a finish of at least 10 micro inches, for example. Suitable bearing balls 322 may have a one-half inch inside diameter and a length of about one and one half inches, for example. Each linear bearing assembly 321 is open at a bottom 324 to receive the mating bearing shaft 326. Suitable shafts 326 may have an outside diameter of about just less than 0.500 inch (plus 0.000 and minus 0.0002 inch) so as to provide the interference fit in the bearing balls 322. The shaft 326 may be about one and one-half inches long. The length 323L of the cage 323 in a direction parallel to the axis 218 is less than a dimension 321HD of the internal bearing housing 321H, and may have a ratio of 3/7 relative to the dimension 321HD of the internal housing 321H. The value of the dimension 321HD is selected according to the desired amount of movement of the shaft 326 in the linear bearing assembly 321. Each housing 320 extends upwardly from one of the tabs 272, and is bolted to the tab by bolts 328. Each shaft 326 extends upwardly from the retainer ring base 274, to which it is bolted by bolts 330.

As the shaft 326 moves with the movement of the retainer ring 226, the shaft 326 is tightly guided by the bearing balls 322. The bearing balls 322 allow the limited movement of the shaft 326 corresponding to the above-described limited movement of the retainer ring 226 relative to the carrier 212, which is the movement parallel to the carrier axis 224 and parallel to the axis 231 of symmetry of the wafer 208. As the shaft 326 so moves, the bearing balls 322 roll against the internal bearing housing 321H such that the cage 323 moves in the direction of the movement of the shaft 326. The above-described relative dimensioning of the internal bearing housing 321H and the cage 323 permits such movement of the cage 323. Such limited movement assures the parallelism among the plane 232 and the plane 234, and the plane 236, and for polishing provides co-planarity of the planes 232 and 234. As described, the limitation of movement imposed by the linear bearing assembly 321 restricts the movement allowed by the gimbal assembly 222. Continued operation of the linear bearing assembly 321 in this manner is fostered by seals 325 located at opposite ends of the internal bearing housing 321H, which are configured to keep foreign matter from entering the housing 321H.

Figure 9:
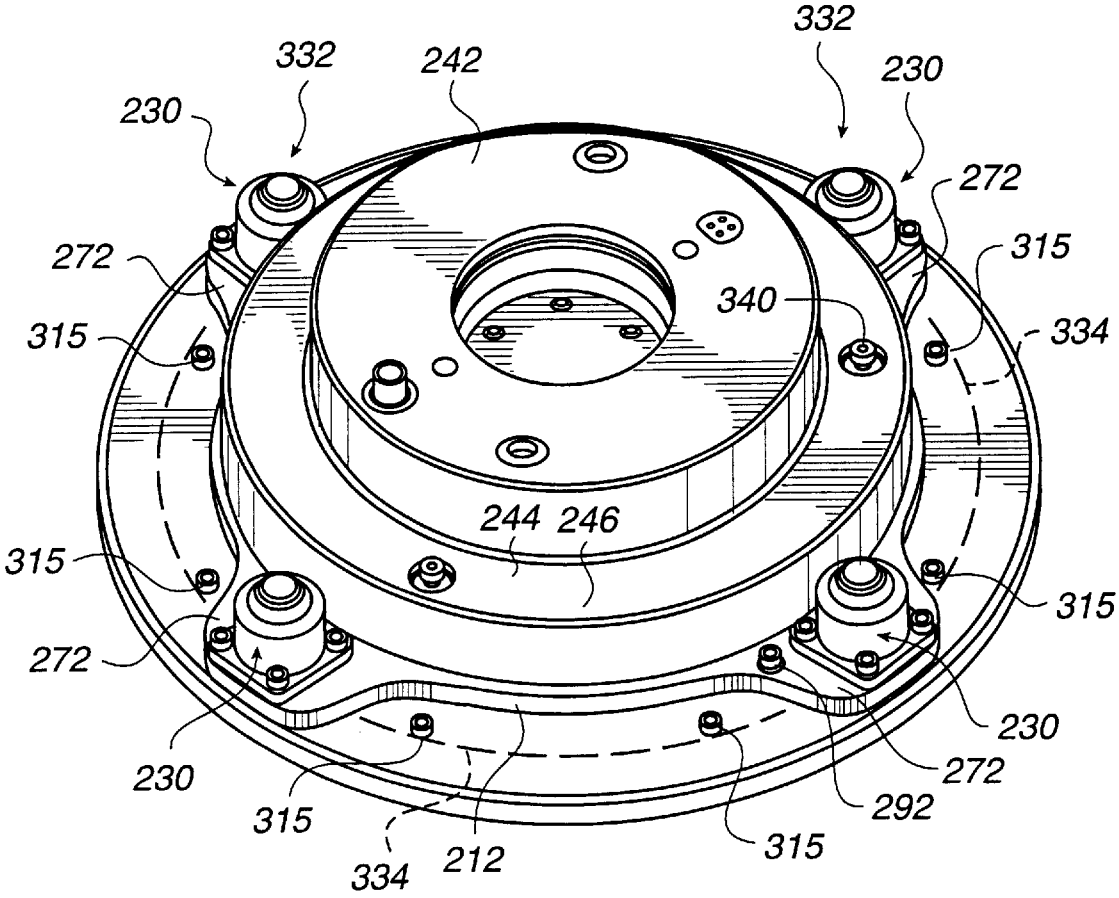
FIG. 9 is a three dimensional view of the wafer carrier plate, illustrating flanges extending from the wafer carrier plate for four linear bearing assemblies.

FIG. 9 shows the linear bearing assemblies 230 as including an array 332 of the linear bearing assemblies 230. The array 332 is configured to divide the operation of each individual linear ball bearing assembly 321 into parts having a short length in the direction of the axis 231 and small diameters relative to the diameters (e.g., 200 mm or 300 mm) of the wafers 208. Moreover, such division locates the linear bearing assemblies 230 at uniformly spaced intervals around a circular path (shown in dashed lines 334). In this manner, as the wafer carrier 212 rotates, there is a rapid succession of individual linear bearing assemblies 230, for example, located over the belt 204. FIG. 9 also shows a uniform spacing of six of the eight bolts 315 around the retainer ring base 274 for holding the base 274 assembled with the retainer ring 226. Supplementing FIG. 4A, FIG. 9 also shows one of the four bolts 292 that are provided with the springs 296 in each of the four tabs 272 for keeping the base 274 biased against the tab 274, and to resiliently release the base 274 and the retainer ring 226 when the bladder 304 of the linear motor 300 is pressurized.

FIG. 9 also shows a pneumatic hose 340 that is attached to the inlet 308 of the linear motor 300. The hose 340 extends to the spindle 220 for connection to a supply (not shown) of the pressurized fluid 306, e.g., air.

Figure 10:
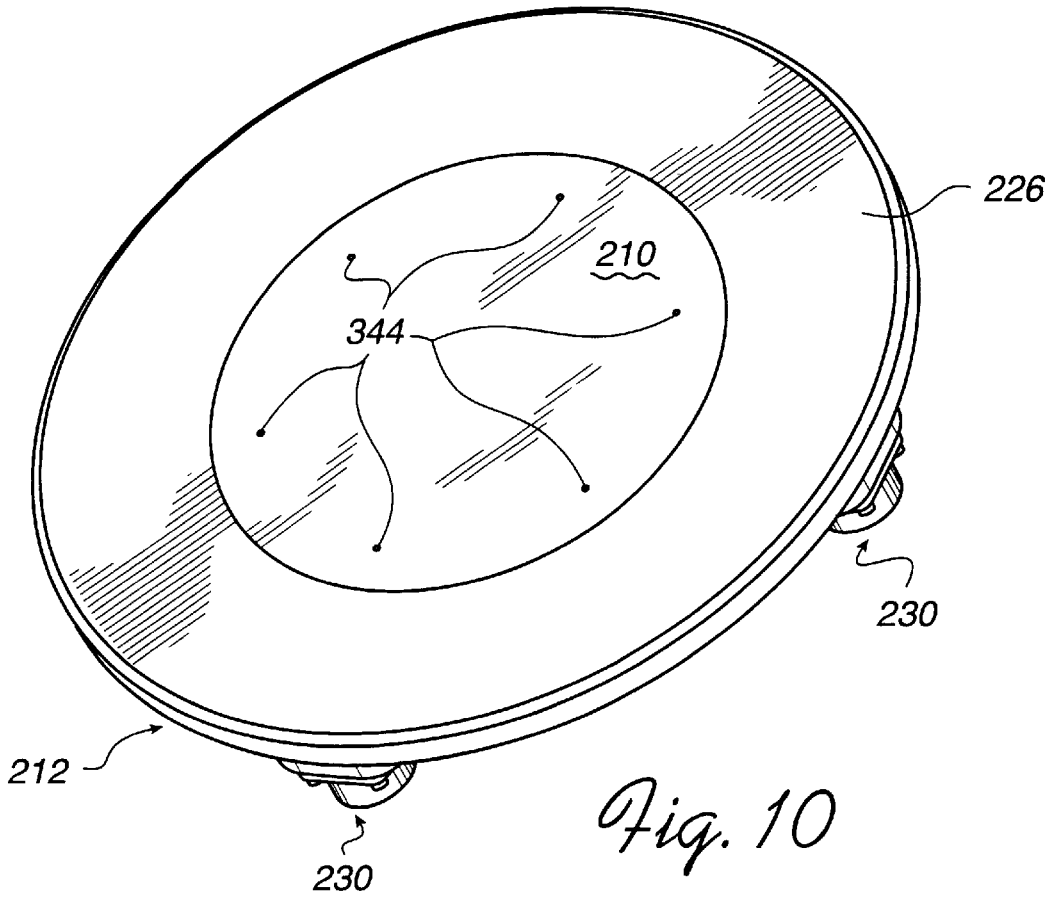
FIG. 10 is a three dimensional view of the wafer carrier plate, illustrating a wafer-engaging surface surrounded by the retainer ring.

FIG. 10 shows the bottom of the wafer carrier 212, including the wafer carrier surface 210. The surface 210 is provided with evenly spaced holes 344 that are either supplied with nitrogen (N2) or connected to a vacuum supply (not shown). FIG. 6 shows a port 346 with a pneumatic connector 347 that is connected to one of many tees 348 that serve as manifolds to distribute the N2 or vacuum to the holes 344 from the spindle 220.

FIG. 7 shows an amplifier 352 connected to the load cell 240 to provide an amplified output to an electrical connector 354. The connector 354 is connected to a conductor that extends through the spindle base 242 to control circuitry (not shown).

Referring now to FIG. 11, a method of the present invention is shown including operations of a flow chart 400 for aligning the exposed (or ring) surface 233 of the retainer ring 226 with the wafer carrier surface 210. The wafer carrier surface 210 may also be referred to as a wafer-engaging surface, and the aligning may be performed during a chemical machining polishing operation. The operations of the flow chart 400 may include an operation 402 of mounting the wafer-engaging surface 210 on the axis 231 of rotation. Operation 402 may include mounting the wafer carrier 212 on the spindle base 242, for example. The method moves to an operation 404 of mounting the retainer ring 226 on and for movement relative to the wafer-engaging surface 210 and relative to the axis 231 of rotation. Such mounting is with the retainer ring 226 free to move other than parallel to, and parallel to, the axis 231 of rotation, and may be provided, for example, by the bolts 250. The method moves to an operation 406 of resisting the freedom of the mounted retainer ring 226 to move other than parallel to the axis of rotation. The resisting may, for example, be provided by the four linear bearing assemblies 230. In resisting such freedom, the linear bearing assemblies 230 only permit the retainer ring 226 to move so that the surface 233 of the retainer ring 226 remains parallel to the surface 210. With a wafer 208 carried by the wafer carrier 212, and with the wafer 208 having sides that are parallel to each other, the retainer ring surface 233 is also parallel to or co-planar with the exposed surface 206 of the wafer 208.

Another aspect of the method of the present invention is described with respect to a flow chart 410 shown in FIG. 12. The method may start by an operation 412 in which the wafer-engaging surface 210 of the carrier 212 and the ring surface 233 are urged toward the belt 214. The wafer 208 and the retainer ring 26 contact the bolt 208. The urging provides the force F1 on the wafer-engaging surface 210 (via the wafer 208) and the force F2 on the retainer ring 226 (e.g., on the surface 233). The method moves to an operation 414 of transferring the force F1 from the wafer-engaging surface 210 and the force F2 from the ring surface 233 to the carrier 212. The transferring operation 414 may be performed by the retainer ring 226 acting on the base 274, which acts on the tab 272 of the carrier 212, for example. The sum of the forces F1 and F2 includes the component force FC parallel to the axis 218. The method may then move to an operation 416 of measuring the respective forces F1 and F2 transferred to the carrier 212. Such measuring is performed by the load cell 240, which measures the value of the component FC parallel to the axis 218.

Figure 13:
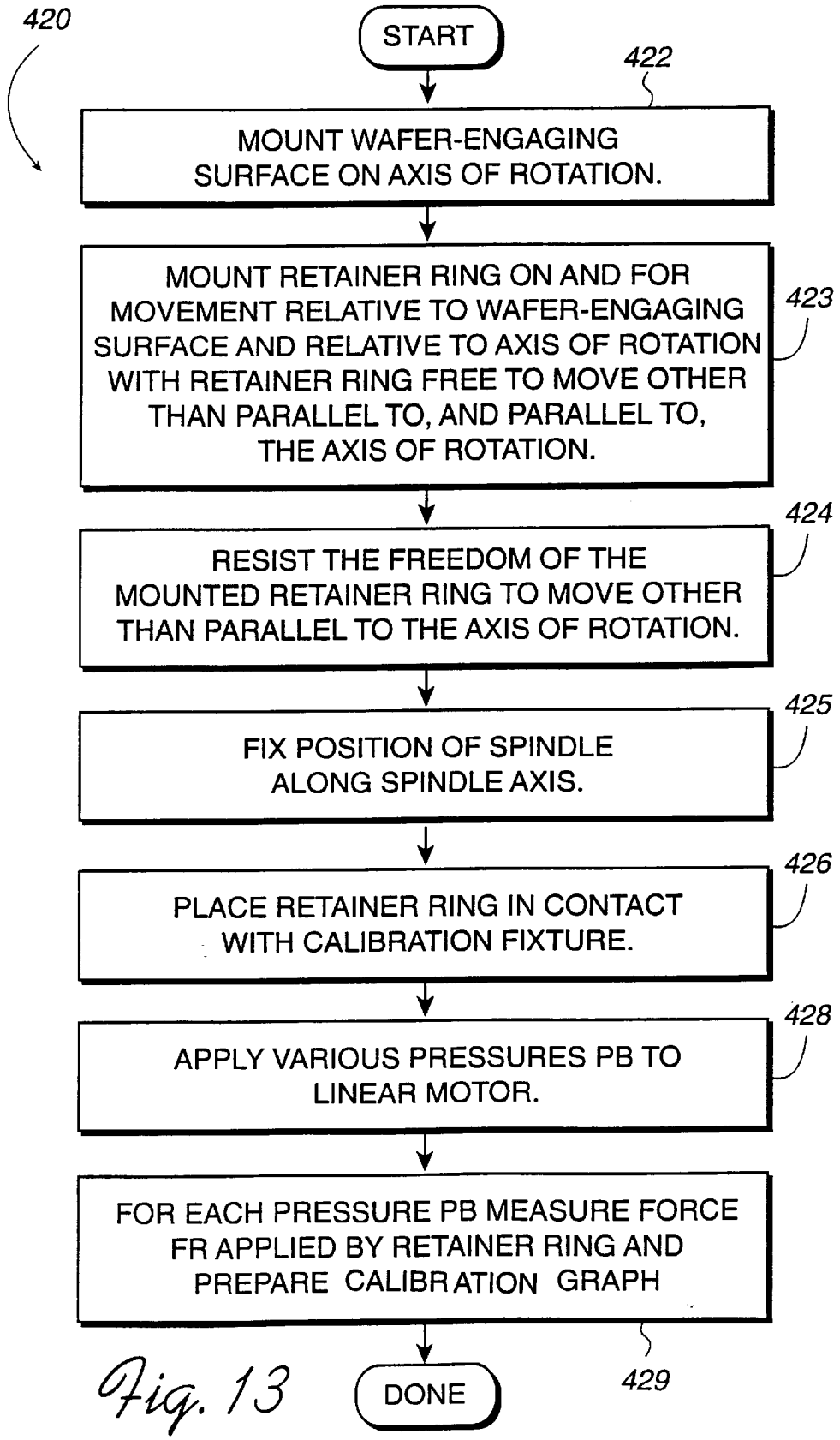
FIG. 13 depicts a flow chart illustrating operations of a method of the present invention for calibrating the retainer ring.
Figure 14:
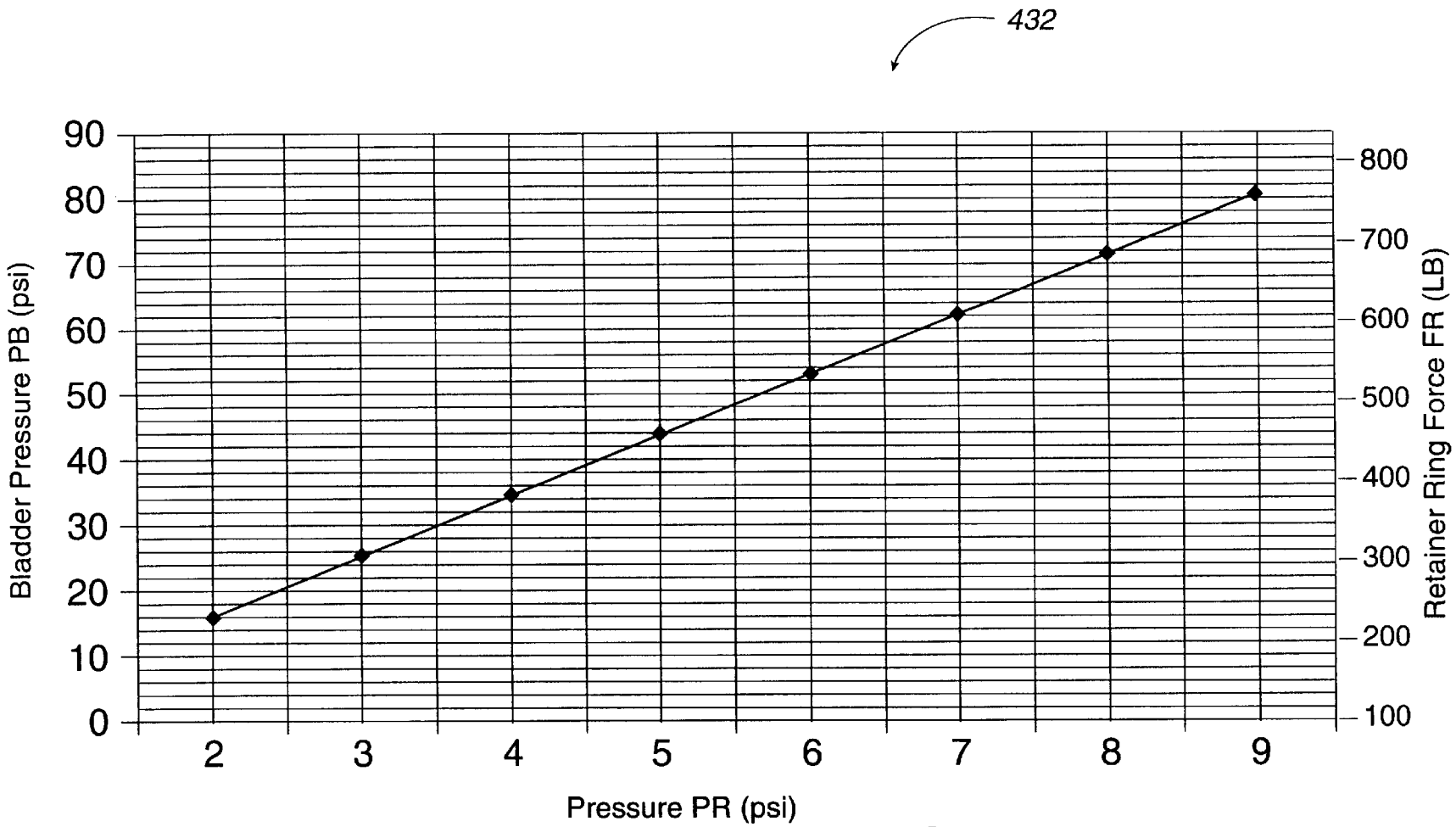
FIG. 14 is a graph resulting from calibrating the retainer ring.

Another aspect of the method of the present invention is described with respect to a flow chart 420 shown in FIG. 13. The method may be used for calibrating the retainer ring 226, which due to the action of the motor 300, is an "active" retainer ring. The retainer ring 226 also has the ring surface 233, and the ring 226 is movable with respect to the wafer-engaging surface 210 during a chemical machining polishing operation in which the ring surface 233 touches the upper, or polishing, surface of the belt 204 (that defines the plane 238 as shown in FIG. 1). The method starts with an operation 422 of mounting the wafer-engaging surface 210 on the axis 224 of rotation. The method moves to an operation 423 of mounting the retainer ring 226 on and for movement relative to the wafer-engaging surface 210 and relative to the axis 224 of rotation with the retainer ring 226 free to move other than parallel to, and parallel to, the axis 224 of rotation. The method moves to an operation 424 of resisting the freedom of the mounted retainer ring 226 to move other than parallel to the axis 224 of rotation. As before, the resisting may be provided by the four linear bearing assemblies 230. In resisting such freedom, the linear bearing assemblies 230 only permit the retainer ring 226 to move so that the surface 233 of the retainer ring 226 remains parallel to the surface 210. The method moves to an operation 425 of fixing the position of the spindle 220 along the axis 218. The method moves to an operation 426 of placing the retainer ring 226 in contact with a calibration, or force measuring, fixture. The fixture may be a standard force sensor (not shown) similar to the load cell 240, and having an annular force sensor plate 427 (FIG. 3) configured to contact the retainer ring 226 without touching the wafer 208 or the surface 210. The method moves to an operation 428 of applying to the linear motor 300 various input pressures PB to cause the bladder 304 to urge the retainer ring 226 axially downward (in the direction of the axis 224) against the force sensor plate 427 of the calibration fixture. The method may move to an operation 429 in which, for each of the plurality of different ones of the input (e.g., for each of many pressures PB of the air supplied to the bladder 304), the force measuring fixture measures the value of the forces FR (FIG. 3) applied by the retainer ring 226. Knowing the area of the retainer ring 226, the forces FR (FIG. 14) may be converted to retainer ring pressures PR (FIG. 14) on the retainer ring in psi. By this method of flow chart 420, operation 428 may conclude by preparing a calibration graph 432 (FIG. 14) by plotting on one axis such retaining ring forces FR (FIG. 14) and on the other axis the corresponding different inputs (pressure PB to the bladder 304), each as a function of retainer ring pressure PR. Referring to FIG. 14, these pressures PB are plotted on the left axis, whereas the forces FR before conversion to pressure (based on a force FR divided by the area of the retainer ring 226) are plotted on the right axis.

Figure 15:
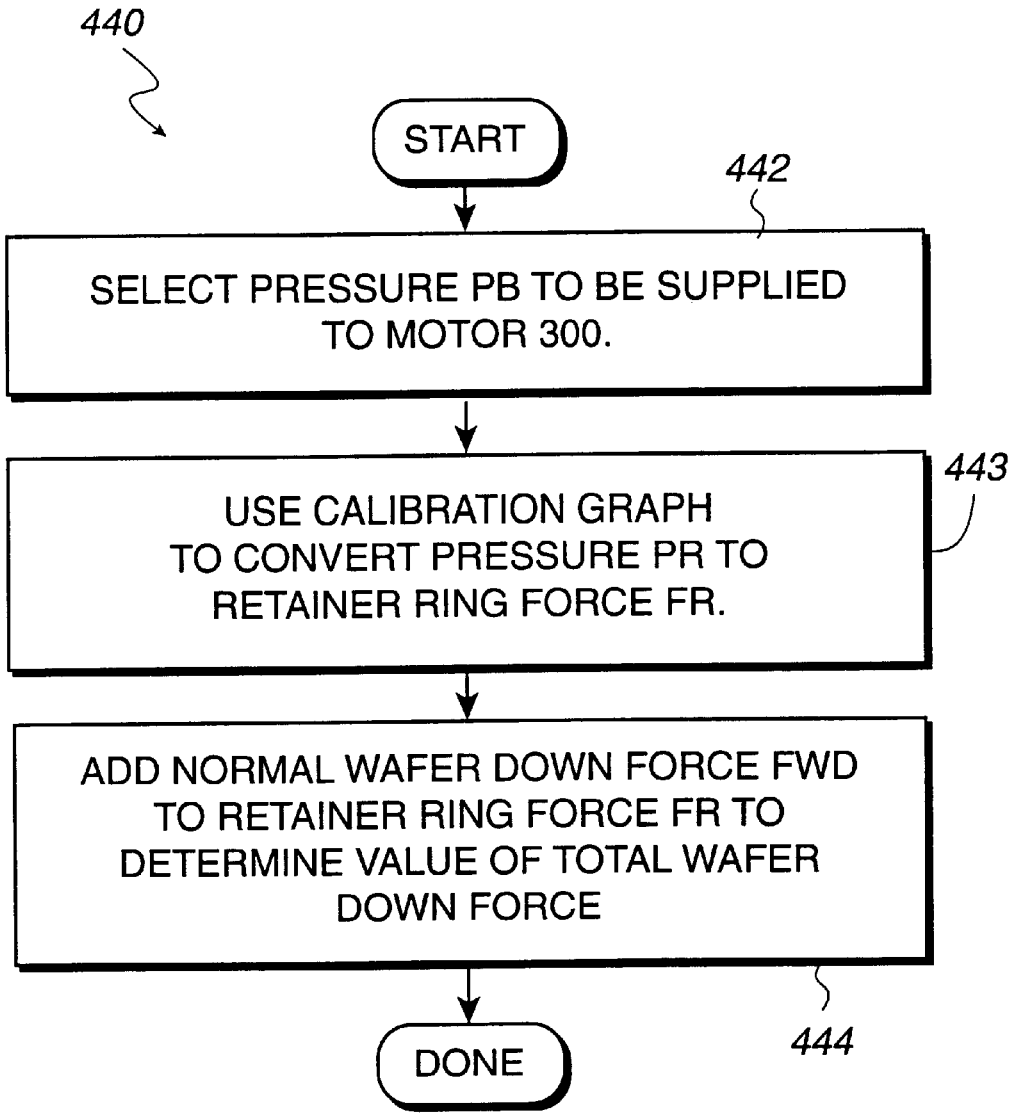
FIG. 15 depicts a flow chart illustrating operations of a method of the present invention for using the calibration graph.

In another aspect of the methods of the present invention, the calibration graph 432 may be used as shown in FIG. 15 in a flow chart 440 for a next actual polishing operation. An operation 442 selects a pressure PB to be supplied to the bladder 304 according to a polishing process specification for the next polishing operation. The method moves to an operation 443 in which, based on the calibration graph 432, the selected pressure PB is used to select a corresponding force FR (shown in FIGS. 3 and 14) of the retainer ring 226 on the belt 204. The force FR has the corresponding opposite force F2. The method moves to an operation 444. Operation 444 is performed with the process specification in mind. In the process specification, a polishing force, which may be termed a wafer down force FWD for descriptive purposes (not shown), is specified for the next polishing operation. The wafer down force FWD is the force by which, without the retainer ling 226, the spindle 220 would normally be urged downwardly in FIGS. 2 and 3, for example, to urge the wafer 208 against the belt 204 for polishing. However, because the retainer ring 226 also contacts the belt 204, applies the force FRR, and receives the opposite force F2 (FIG. 3), such wafer down force FWD by which the spindle 220 would normally be urged downwardly is not the force that is applied by the wafer 208 against the belt 204. Rather, the force FC described above has the two components F1 and F2, and only the component F1 corresponds to the polishing force (or to the wafer down force FWD) between the wafer 208 and the polishing surface of the belt 204. In operation 444, the force FR of the retainer ring 226 is added to this wafer down (normal) force FWD derived from the process specification. In this manner operation 444 provides a value of the total downward force of the spindle 220 that is greater than the normal wafer down force FWD used without the retainer ring 226. Thus, the spindle 220 is urged downwardly by a force opposed to and equal to the force FC which includes the forces F1 and F2.

Figure 17A:
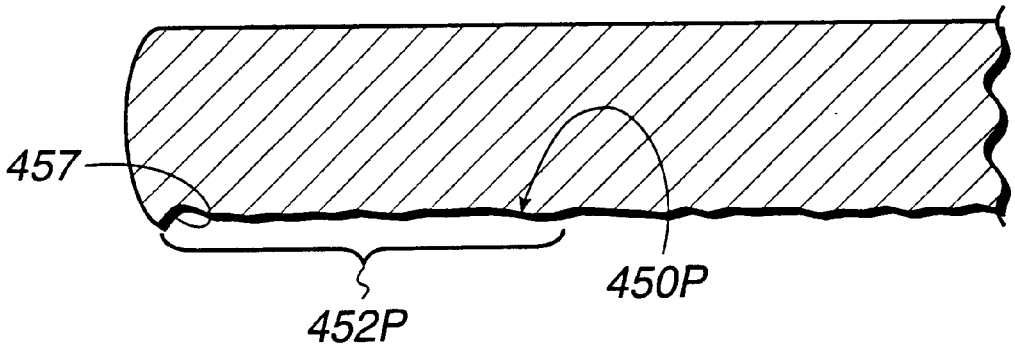
FIG. 17A is a cross sectional view of the outer edge of a wafer polished using a retainer ring that is not provided with the linear bearing assemblies of the present invention.
Figure 17B:
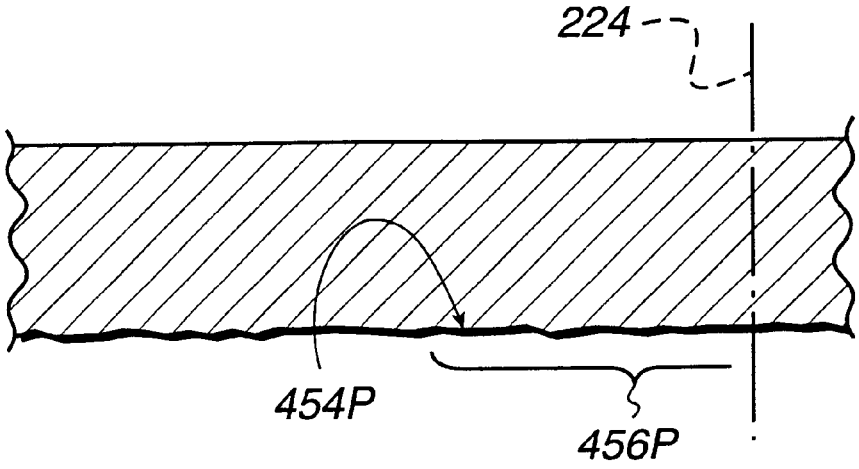
FIG. 17B is a cross sectional view of the wafer shown in FIG. 17A, illustrating a profile of a central portion of the wafer.

Another aspect of the methods of the present invention may be used to reduce a cause of differences between an edge profile (identified by an arrow 450 in FIG. 8) of a chemical mechanical polished edge portion 452 of the wafer 208, and a center profile (identified by an arrow 454 in FIG. 8) of a chemical mechanical polished central portion (identified by a bracket 456) of the wafer 208. As shown in FIG. 8, the edge profile 450 and the center profile 454 have generally the same contour as a result of the present invention. On the other hand, FIGS. 17A and 17B show portions of a typical wafer 208 that has been polished using a retainer ring positioned to provide a reveal 227 of about 0.009 inches. Such retainer ring is not provided with the linear bearing assemblies 230. The portions shown include an edge profile (identified by an arrow 450P in FIG. 17A) of a chemical mechanical polished edge portion 452P of the wafer 208, and a center profile (identified by an arrow 454P in FIG. 17B) of a chemical mechanical polished central portion (identified by a bracket 456P) of the wafer 208. FIG. 17B shows the profile 454P having a somewhat wavy shape to represent about a three to five percent variation in the height of the profile 454P (which generally is an acceptable profile). In comparison, FIG. 17A shows the edge profile 450P having a sharp step 457representing substantially more than the three to five percent variation in the height of the edge profile 454P. Such step 457 and the corresponding increased variation is an unacceptable edge profile. The edge profile 450P may result from the dynamics of the belt 204 resulting from the initial contact of the belt 204 and the wafer edge portion 452P. Such dynamics do not dissipate because the retainer ring that provides the reveal of 0.009 inches does not contact the belt 204 before the belt 204 contacts the edge portion 450P of the wafer 208. Further, the above-described tilting of the prior retainer rings (resulting in differences in the values of the reveal around the perimeter of the wafer 208) were said to be undesirable because they are uncontrolled and have caused problems in CMP operations. One type of problem is the unacceptable edge profile 450P.

On the other hand, as described above, because a portion of the belt 204 first contacts the retainer ring 226 of the present invention, and because the retainer ring 226 is co-planar with the exposed surface of the wafer 208 during polishing, the dynamics of the portion of the belt 204 resulting from the portion of the belt 204 initially contacting the retainer ring 226 dissipate so that the portion of the belt 204 is substantially in a steady-state condition as the portion of the belt 204 advances past the retainer ring 226 and moves onto the edge of the wafer 208. In the steady-state condition the belt 204 tends to polish with only about a three to five percent height variation of the edge profile 452 and center profile 454, in each case without the unacceptable sharp steps (e.g., 457) depicted in FIG. 17A, for example.

Figure 16:
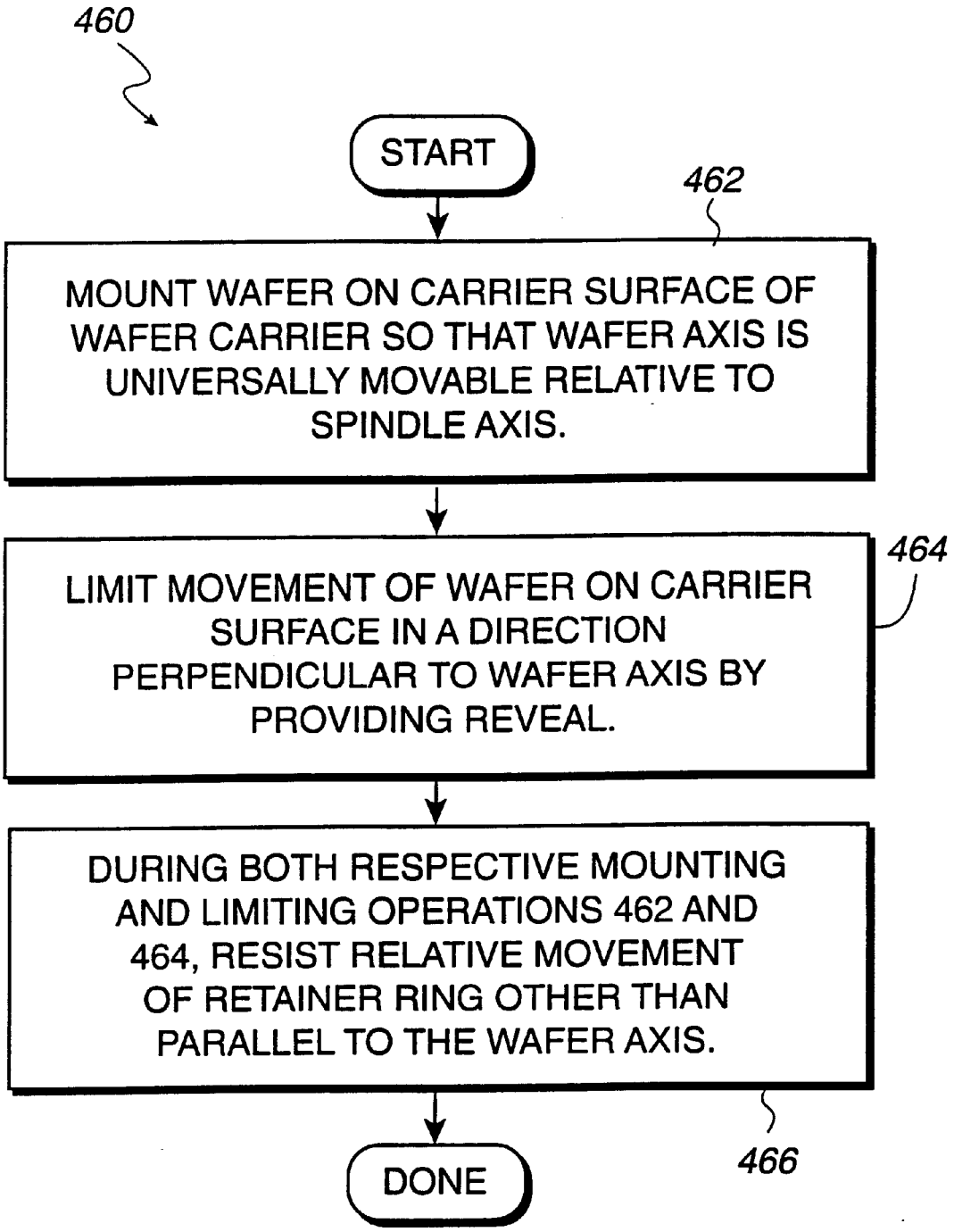
FIG. 16 is a flow chart depicting operations of a method of the present invention for reducing a cause of differences between an edge profile of a chemical mechanical polished edge portion of the wafer and a center profile of a chemical mechanical polished central portion of the wafer within the edge portion.

As shown in FIG. 16 another aspect of the methods of the present invention is depicted in a flow chart 460. A method includes an operation 462 of mounting the wafer 208 on the carrier surface 210 of the wafer carrier 212 so that the wafer axis 231 of rotation is universally movable relative to the spindle axis 218 of rotation of the wafer spindle 220. The method moves to an operation 464 for limiting movement of the wafer 208 on the carrier surface 210 in a direction perpendicular to the wafer axis 231 by movably mounting the retainer ring 226 on and relative to the wafer carrier 212. The limiting operation 464 may be performed by providing the reveal 227. The method moves to an operation 466 in which, during both the respective mounting and the limiting operations 462 and 464 the relative movement of the retainer ring 226 other than parallel to the wafer axis 231 is resisted. The resisting operation 466 may be performed by configuring components of the linear bearing assemblies 230 so that a direction of the only permitted movement between the wafer carrier 212 and the retainer ring 226 is parallel to the wafer axis 231. The resisting operation 466 may further include mounting the linear bearing components on the respective wafer carrier 212 and retainer ring 226.

It may be understood that the cause of the differences between the edge profile 450P and the center profile 454P may be a lack of co-planarity of the wafer plane 234 defined by the exposed to-be-polished surface 206 of the wafer 208, and the ring plane 232 defined by the exposed polishing-member-engaging surface 233 of the retainer ring 226. The operation 462 of mounting the wafer 208 on the carrier surface 210 renders the wafer plane 234 universally movable relative to the spindle axis 218, and gives rise to the problem of lack of such co-planarity. The operation 466 of resisting the relative movement of the retainer ring 226 other than parallel to the wafer axis 231 results, for example, in enabling the operation of the bladder 304 to achieve the desired co-planarity of the wafer plane 234 and the ring plane 232 (FIG. 4B) during polishing, thus eliminating this cause of the differences between the edge profile 450P and the center profile 454P.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. Apparatus for controlling a positional relationship in a chemical mechanical polishing system, the apparatus comprising:

a wafer carrier plate having a carrier plate surface configured to mount a wafer for contact with a chemical mechanical polishing surface;

a retainer ring assembly mounted on and for movement relative to the wafer carrier plate to retain the wafer in a desired position on the carrier surface, the retainer ring assembly having a ring surface configured to contact the polishing surface; and a bearing assembly mounted between the wafer carrier plate and the retainer ring assembly to limit the movement of the retainer ring assembly relative to the carrier plate so that the ring surface is positioned parallel to the carrier plate surface.

2. Apparatus as recited in claim 1, wherein:

the bearing assembly is configured with a bearing housing mounted on one of the wafer carrier plate and the retainer ring, and a bearing shaft is mounted on the other of the wafer carrier plate and the retainer ring assembly, the bearing shaft being received in the bearing housing.

3. Apparatus as recited in claim 1, further comprising:

a drive mounted between the wafer carrier plate and the retainer ring assembly to control a reveal position of the ring surface relative the carrier plate surface.

4. Apparatus as recited in claim 3, wherein:

the bearing assembly is effective during the control of the reveal position of the ring surface relative the carrier plate surface to maintain the ring surface parallel to the carrier plate surface.

5. Apparatus as recited in claim 1, further comprising:

a spindle configured to mount the wafer carrier plate for rotation, the spindle having a base closely adjacent to the wafer carrier plate, the base being configured to receive a first gimbal member;

a second gimbal member configured to cooperate with the first gimbal member and secured to the wafer carrier plate to allow the wafer carrier plate to be positioned in any position in a range of polishing positions in which the carrier plate surface is parallel to the polishing surface; and wherein with the carrier plate surface parallel to the polishing surface the bearing assembly is effective to limit the movement of the retainer ring assembly relative to the carrier plate so that the ring surface is positioned co-planar with the polishing surface.

6. Apparatus for controlling positional relationships with respect to a chemical mechanical polishing surface, the apparatus comprising:

a spindle;

a wafer carrier having a wafer carrier surface;

a gimbal assembly having a first gimbal member mounted on the spindle and a second gimbal member mounted on the carrier, the second gimbal member mating with the first gimbal member to permit gimballing motion of the carrier relative to the spindle into a polishing position in which the wafer carrier surface is parallel to the polishing surface;

a retainer ring assembly mounted on and for movement relative to the wafer carrier, the retainer ring assembly having a ring surface configured to contact the polishing surface; and a bearing assembly mounted between the wafer carrier and the retainer ring assembly, the bearing assembly being configured to limit the movement of the retainer ring assembly relative to the carrier so that the ring surface is positioned parallel to the carrier surface.

7. Apparatus as recited in claim 6, further comprising:

a drive positioned between the wafer carrier and the retainer ring assembly to move the ring surface relative the carrier surface.

8. Apparatus as recited in claim 6, wherein the spindle is configured to provide a rotational force and the gimbal assembly is configured with at least one connector for transferring the rotational force to the carrier.

9. Apparatus as recited in claim 6, wherein:

the bearing assembly is configured with a linear bearing housing on one of the wafer carrier and the retainer ring assembly and with a linear bearing shaft on the other of the wafer carrier and the retainer ring assembly.

10. Apparatus as recited in claim 6, further comprising:

a sensor mounted on the spindle and having a force input connected to the first gimbal member to receive a polishing force.

11. Apparatus as recited in claim 10, wherein:

the spindle is configured with a cavity to receive and position the sensor closely adjacent to the wafer carrier; and the wafer carrier is configured with a recess to receive the first and second gimbal members and enable the force input of the sensor to be closely adjacent to the wafer carrier surface.

12. Apparatus for controlling positional relationships in a chemical mechanical polishing system, the apparatus comprising:

a spindle configured to provide a rotational force, the spindle having a first gimbal member;

a gimbal assembly having a second gimbal member configured to cooperate with the first gimbal member to permit gimballing motion in which the second member moves universally relative to the spindle, the gimbal assembly having a drive connector for transferring the rotational force;

a wafer carrier mounted on the second gimbal member and provided with a wafer carrier surface, the gimbal members allowing the gimballing motion of the wafer carrier into a polishing position in which the wafer carrier surface is parallel to the polishing surface, the wafer carrier having a drive socket configured to receive the drive connector and allow the gimballing motion while transferring the rotational force to the carrier;

a retainer ring assembly mounted on and for movement relative to the wafer carrier into a reveal position to provide a reveal for retaining the wafer on the wafer carrier surface, the retainer ring assembly having a ring surface configured to contact the polishing surface; and a linear bearing assembly mounted separately from the spindle and between the wafer carrier and the retainer ring assembly to permit only limited movement of the retainer ring assembly relative to the carrier, the limited movement being with the ring surface oriented parallel to the carrier surface during the gimballing motion.

13. Apparatus as recited in claim 12, further comprising:

a drive positioned between the wafer carrier and the retainer ring assembly to move the ring surface relative to the wafer carrier surface and permit the selection of a value of the reveal.

14. Apparatus for controlling structural movement of a semiconductor wafer carrier in chemical mechanical polishing, the apparatus comprising:

a carrier plate having a wafer mount surface centered relative to a carrier axis of rotation of the carrier plate;

a retainer ring surrounding the wafer mount surface;

a connector arrangement configured to mount the retainer ring on and for movement relative to the carrier plate in a plurality of directions including a first direction parallel to the carrier axis and other directions not parallel to the carrier axis; and a linear bearing arrangement having at least one first unit secured to the carrier plate and at least one second unit secured to the retainer ring, the at least one second unit being movable relative to the at least one first unit, the at least one first unit and the at least one second unit being configured to resist all of the movement of the retainer ring relative to the carrier plate in the plurality of directions except movement in the first direction parallel to the carrier axis.

15. Apparatus according to claim 14, wherein:

the wafer mount surface is configured to be coaxial with the carrier axis and centrally located adjacent to the axis; and the linear bearing arrangement includes an array of linear bearings positioned along an arcuate path around the central wafer mount surface, each of the linear bearings has one of the at least one first units secured to the carrier plate radially outwardly of the wafer mount surface, each of the linear bearings has one of the at least one second units secured to the retainer ring radially outwardly of the wafer mount surface.

16. Apparatus according to claim 14, further comprising:

a coupler having a drive axis of rotation and configured to rotate the carrier plate, the coupler having a first gimbal surface configured to cooperate with a second gimbal surface;

wherein the carrier plate is provided with the second gimbal surface cooperating with the first gimbal surface to permit the carrier plate and the retainer ring on the carrier plate to move relative to the coupler so that the carrier axis may tilt with respect to the drive axis; and wherein during the movement of the carrier plate relative to the coupler the linear bearing arrangement permits movement of the retainer ring relative to the carrier plate only in the first direction parallel to the carrier axis.

17. Apparatus according to claim 16, wherein separate polishing forces are applied to the retainer ring and to the carrier plate and each of the separate polishing forces has a parallel component parallel to the carrier axis and a component other than parallel to the carrier axis, the apparatus further comprising:

a sensor mounted on the coupler and having a force input, the sensor being configured so that the force input may be contacted by the first gimbal surface; and wherein the configuration of the connector for mounting the retainer ring on and for movement relative to the carrier plate, and the linear bearing arrangement permitting movement of the retainer ring relative to the carrier plate only in the first direction parallel to the carrier axis, enable only the parallel component of the separate polishing force applied to the retainer ring to be applied to the carrier plate for sensing by the sensor.

* * * * *